US010087614B2

(12) United States Patent
Zhou et al.

(10) Patent No.: US 10,087,614 B2
(45) Date of Patent: Oct. 2, 2018

(54) SUPPORT STRUCTURE AND ASSEMBLY

(71) Applicant: Jianhui Zhou, Quanzhou (CN)

(72) Inventors: Jianhui Zhou, Quanzhou (CN); Dingming Zhou, Quanzhou (CN)

(73) Assignee: QUANZHOU DINGWEI CONSTRUCTION TECHNOLOGY CO., LTD, Quanzhou (CN)

( * ) Notice: Subject to any disclaimer, the term of this patent is extended or adjusted under 35 U.S.C. 154(b) by 0 days.

(21) Appl. No.: 15/654,696

(22) Filed: Jul. 20, 2017

(65) Prior Publication Data

US 2017/0362810 A1 Dec. 21, 2017

Related U.S. Application Data

(60) Division of application No. 15/049,076, filed on Feb. 20, 2016, now Pat. No. 9,797,124, which is a (Continued)

(30) Foreign Application Priority Data

Nov. 22, 2013 (CN) ..... 2013 1 0602085

(51) Int. Cl.

| | |
|---|---|
| ***E04B 1/58*** | (2006.01) |
| ***E04B 1/19*** | (2006.01) |
| ***E04H 12/08*** | (2006.01) |
| ***E04H 12/10*** | (2006.01) |
| *E04H 12/00* | (2006.01) |
| *E04C 3/08* | (2006.01) |

(Continued)

(52) U.S. Cl.

CPC ..... *E04B 1/1903* (2013.01); *E04H 12/085* (2013.01); *E04H 12/10* (2013.01); *E04B 1/585* (2013.01); *E04B 2001/1957* (2013.01); *E04C 3/08* (2013.01); *E04C 2003/0491* (2013.01); *E04G 1/06* (2013.01); *E04G 7/14* (2013.01); *E04H 2012/006* (2013.01)

(58) Field of Classification Search

CPC ..... E04B 1/1903; E04B 2001/1957; E04B 1/585; E04B 1/5837; E04H 12/10; E04H 2012/006; E04C 2003/0486

See application file for complete search history.

(56) References Cited

U.S. PATENT DOCUMENTS 1,706,801 A * 3/1929 Merrill ..... E04G 7/16 403/385

2,165,221 A * 7/1939 Burton ..... E04G 7/24 24/335

(Continued)

*Primary Examiner* — Gisele D Ford

(74) *Attorney, Agent, or Firm* — Wayne & Ken, LLC; Tony Hom

(57) ABSTRACT

A combined member, comprising a communication rod (1) and a connecting rod (2), wherein the connecting rod (2) comprises a rod body (2.1) and a connector (2.2), the connector (2.2) being a fastening connector (3) or a sleeving connector (4), the rod body (2.1) of the connecting rod (2.1) and a rod body of the communication rod (1) being of a strip-shaped structure, the connecting rod (2) being connected to the communication rod (1) by the fastening connector (3) or the sleeving connector (4), the axis of the connecting rod (2) intersecting that of the communication rod (1) connected thereto. The combined member has the advantages of high bearing capacity, and convenient construction.

5 Claims, 39 Drawing Sheets

Related U.S. Application Data continuation of application No. PCT/CN2014/091955, filed on Nov. 21, 2014.

(51) Int. Cl.

| | |
|---|---|
| *E04C 3/04* | (2006.01) |
| *E04G 1/06* | (2006.01) |
| *E04G 7/14* | (2006.01) |

(56) References Cited

U.S. PATENT DOCUMENTS

| | | | | | |
|---|---|---|---|---|---|
| 4,505,609 | A * | 3/1985 | Vella | E04H 15/18 | 403/170 |
| 4,878,642 | A * | 11/1989 | Kirby, Jr. | A47K 1/08 | 248/230.1 |
| 5,193,930 | A * | 3/1993 | Chi | B62K 21/12 | 403/191 |
| 5,405,113 | A * | 4/1995 | Jaw | B62J 11/00 | 224/425 |
| 5,443,232 | A * | 8/1995 | Kesinger | F16L 3/24 | 248/62 |
| 6,695,156 | B1 * | 2/2004 | Wang | A47B 57/265 | 108/147.11 |
| 6,957,479 | B2 * | 10/2005 | Londono | B27J 1/00 | 264/262 |
| 7,311,233 | B2 * | 12/2007 | Chen | B62J 11/00 | 224/425 |
| 9,192,250 | B2 * | 11/2015 | Maurer | A47F 5/01 | |
| 2012/0263545 | A1 * | 10/2012 | Oestergaard | E02B 17/00 | 405/227 |
| 2014/0328632 | A1 * | 11/2014 | Lefranc | E02B 17/027 | 405/225 |

* cited by examiner

SUPPORT STRUCTURE AND ASSEMBLY

CROSS-REFERENCE TO RELATED APPLICATIONS

This application is DIVISION of non-provisional patent application Ser. No. 15/049,076 with a filing date of Feb. 20, 2016, now pending, which is a continuation of International Patent Application No. PCT/CN2014/091955 with an international filing date of Nov. 21, 2014, designating the United States, and further claims priority benefits to Chinese Patent Application No. 201310602085.6, filed Nov. 22, 2013. The contents of all of the aforementioned applications, including any intervening amendments thereto, are incorporated herein by reference.

TECHNICAL FIELD

The present invention relates to a combined member and a stable support formed thereby having the advantages of diverse combinations, wide generality, simple and convenient construction, stable and reasonable structure, accurate combination size and angle, and is suitable for large-scale industrial production.

BACKGROUND

At present, there is a lack of a multipurpose combined member which has the advantages of wide practicability, diverse combinations, accurate combination size and angle, simple and convenient construction, etc. at the same time in the industry, and can form a stable support with high bearing capacity which can be used as a main bearing structure of both a temporary construction and a permanent construction.

SUMMARY OF THE INVENTION

The purpose of the present invention is to provide a multipurpose combined member which has the advantages of wide practicability, diverse combinations, accurate combination size and angle, simple and convenient construction, etc. at the same time, and can form a stable support with high bearing capacity which can be used as a main bearing structure of both a temporary construction and a permanent construction.

The purpose of the present invention is realized by the following technical solution:

A combined member, characterized by comprising: a communication rod and a connecting rod, wherein the connecting rod comprises a rod body and a connector, the connector being a fastening connector or a sleeving connector, the rod body of the connecting rod and a rod body of the communication rod being of a strip-shaped structure, the connecting rod being connected to the communication rod by the fastening connector or the sleeving connector, and the axis of the connecting rod intersecting that of the communication rod connected thereto.

A stable support formed by the combined member, characterized in that the projections of connecting rods in the axial directions of communication rods are in the shape of a triangular mesh, the projections of the communication rods are nodes of the triangular mesh, the projections of the connecting rods are the sides of the triangular mesh, the projections form a complete triangular mesh and three adjacent connecting rods of which the axes are mutually perpendicular to those of the communication rods are connected to each other by the communication rods to form a planar stable structure, and a connecting rod (2.4) having an axis which makes an angle of less than 90° with that of the communication rod (1) and connected between two communication rods (1) forms an overall stable structure of the stable support together with the planar stable structure.

Compared with the prior art, the present invention has the advantages that:

(1) By conducting standard design on the combined member of the present invention, the standard production in the factory of each member of the present invention is realized, accurately controlling the size and the connecting angle of the communication rods and the connecting rods is realized, and quick assembling is realized using no re-welding or only using little welding on site;

(2) Connectors are specially designed, when a fastening connector structure is adopted by a connector, two connectors which are fastened with each other are tightened by a bolt assembly, so that not only the pressure of the fastening portion of the fastening connector on a communication rod or a connecting rod fastened therewith is increased, but also the frictional force of the joint between the connector and the communication rod or the connecting rod is increased at a geometric level; and when a sleeving connector structure is adopted by the connector, the outer sleeve and the inner sleeve are fitted and tightly sleeved with each other, an inner conical surface of the outer sleeve will force the inner tight sleeve to contract, thereby reducing the gap between the inner sleeve surface and a communication rod and achieving tight fitting;

(3) The planar connecting rods are adopted to be connected to the communication rods, to easily meet the accurate control of the size and overlapping angle, and form a regular-triangle structure with a stable structure which has high stress reallocation capacity, to enable the construction constructed thereby to have less material utilization amount and higher bearing capacity as compared with other structures forms under the same strength of materials, thereby achieving relatively high economic benefits;

(4) The inclined connecting rods are fitted with the planar connecting rods to form a stable structure in the vertical direction together with the communication rods, so that the construction is easy to form a whole with a stable structure; and (5) It is decided that the axes of the connected rods intersect by the connection form, thereby being beneficial to the transfer of force.

The present invention has the advantages that: the stable support can be accurately assembled on a large scale as required, the stable support has high bearing capacity and can be used as a main bearing structure of both a temporary construction and a permanent construction; and moreover, when the stable support is assembled, the size of a joint and the angle between rods are accurate, and assembling can be completed using only few welding or even using no welding, thereby having the advantage of convenient construction.

LEGENDS

1. Communication rod; 1.1. Flange; 1.2. Variable-diameter base; 1.3. Central communication rod; 1.4. Reinforced communication rod; 2. Connecting rod; 2.1. Rod body; 2.2. Connector; 2.3. Planar connecting rod; 2.4. Inclined connecting rod; 2.5 Vertical plane connecting rod; 3. Fastening connector; 3.1. Fastening portion; 3.2 Connecting portion; 4. Sleeving connector; 4.1. Outer sleeve; 4.2. Inner tight sleeve; 4.21. Notch; 4.3. Tightening bolt; 4.4. Upper connecting lug; 4.5. Lower connecting lug; 5. Connecting supporting plate; 6. Connecting bolt; 7. Bearing block; 8. Fastening connector plinth; 9. Siamesed device; 10. Variable-diameter union; 11. Horizontal beam; 12. Inner sleeve pipe; 13. Outer sleeve pipe; 14. Transition sleeve pipe; 15. Locating ring; 15.1. Annular portion; 15.2. Butting portion; a, b, c, Plane.

DETAILED DESCRIPTION

The present invention is described beneath in detail in combination with the drawings of the description and embodiments.

Figure 1A:
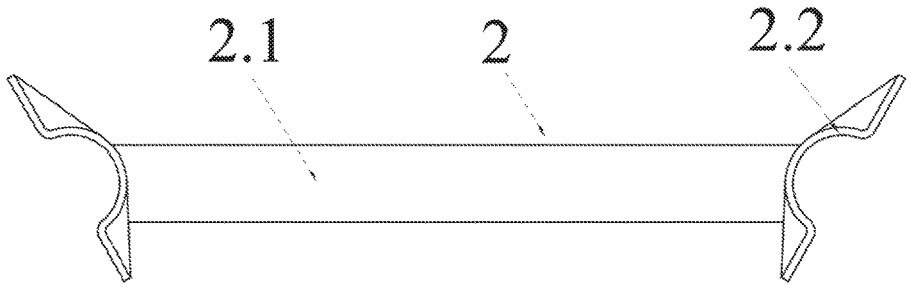
FIG. 1A is a side view of a connecting rod of a preferred embodiment of one of combined members of the present invention.
Figure 1B:
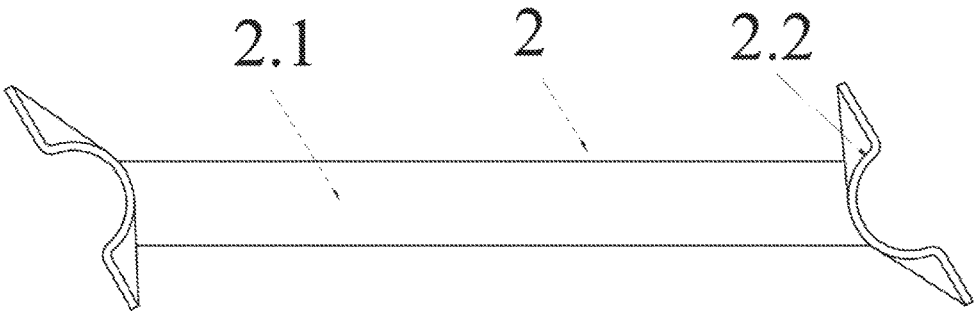
FIG. 1B is a side view of a connecting rod of a preferred embodiment of one of combined members of the present invention.
Figure 1C:
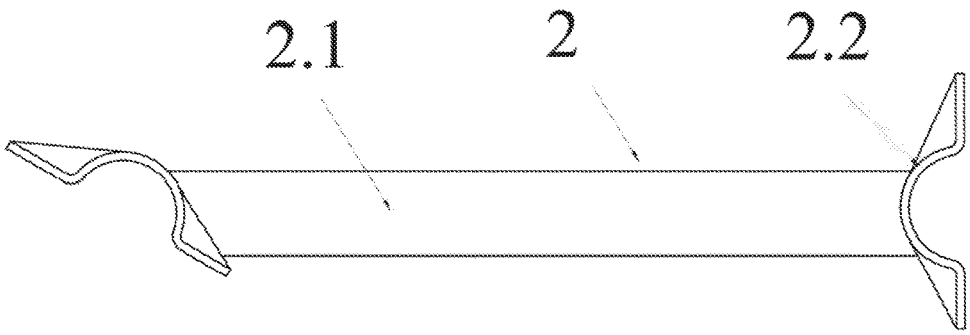
FIG. 1C is a side view of a connecting rod of a preferred embodiment of one of combined members of the present invention.
Figure 1D:
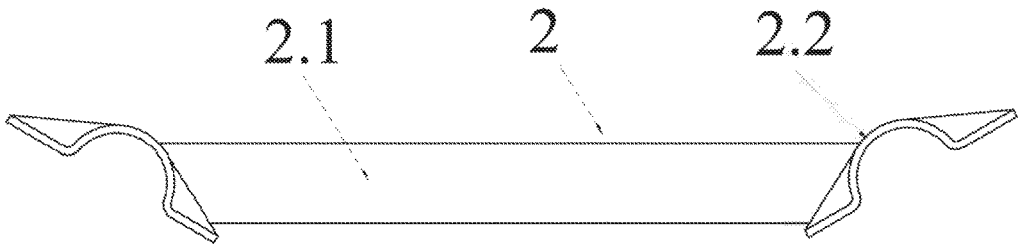
FIG. 1D is a side view of a connecting rod of a preferred embodiment of one of combined members of the present invention.
Figure 1E:
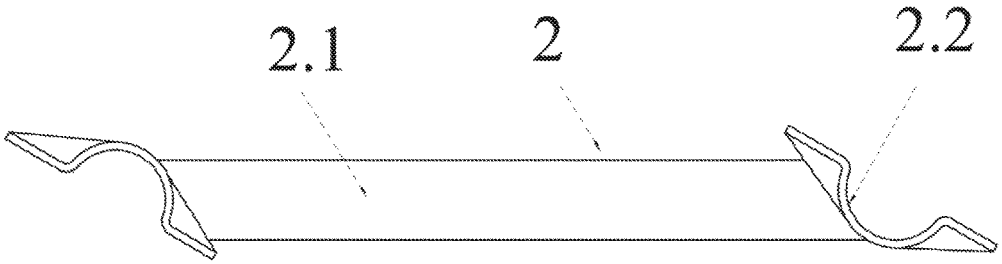
FIG. 1E is a side view of a connecting rod of a preferred embodiment of one of combined members of the present invention.
Figure 2:
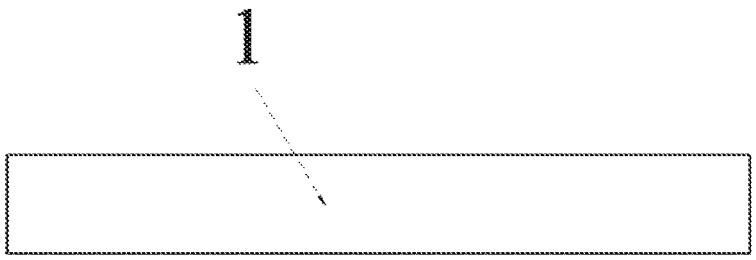
FIG. 2 is a side view of a communication rod of a preferred embodiment of one of combined members of the present invention.
Figure 3:
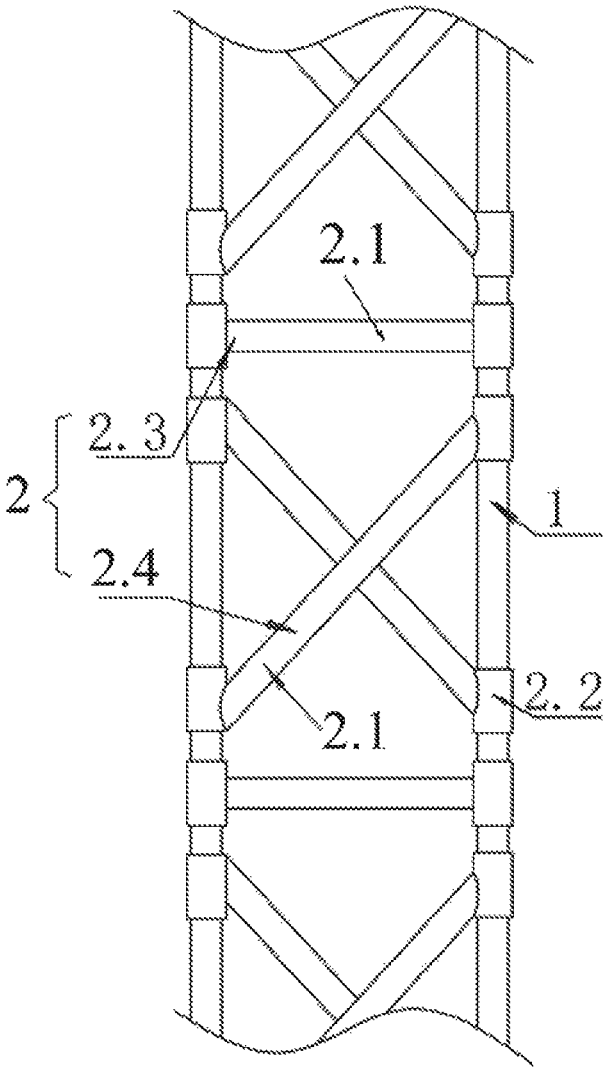
FIG. 3 is a local side view of a preferred embodiment of one of triangular stable supports of the present invention.
Figure 4:
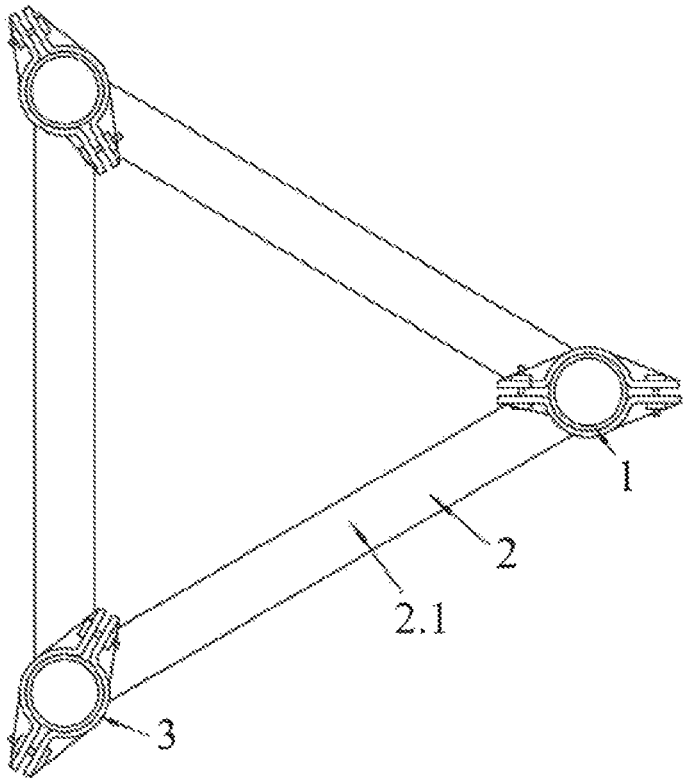
FIG. 4 is a top view of FIG. 3.

As shown in FIGS. 1A to 1E and 2 to 4, a combined member, comprising a communication rod (1) and a connecting rod (2), wherein the connecting rod (2) comprises a rod body (2.1) and a connector (2.2), the rod body (2.1) being integrated with the connector (2.2), the rod body (2.1) of the connecting rod and a rod body of the communication rod (1) being of a strip-shaped structure, the connecting rod (2) being connected to the communication rod (1) by the fastening connector (3) or the sleeving connector (4), the axis of the connecting rod (2) intersecting that of the communication rod (1) connected thereto. As shown in FIGS. 2 to 4, in a preferred embodiment, the rod body of the communication rod (1) is a circular pipe body, but is not limited to this. In a preferred embodiment, as shown in FIGS. 2 to 4, the rod body (2.1) of the connecting rod (2) is a circular pipe body; and in a preferred embodiment, the rod body (2.1) of the connecting rod (2) is a square pipe body, but is not limited to this.

Figure 5:
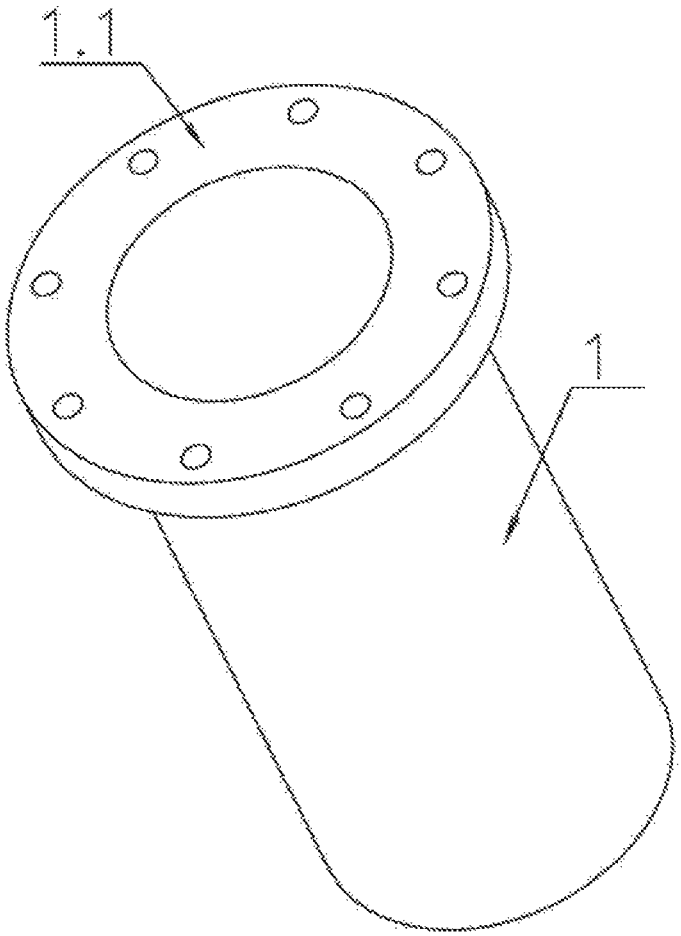
FIG. 5 is a stereographic outside view of a communication rod of a preferred embodiment of one of combined members of the present invention.
Figure 6:
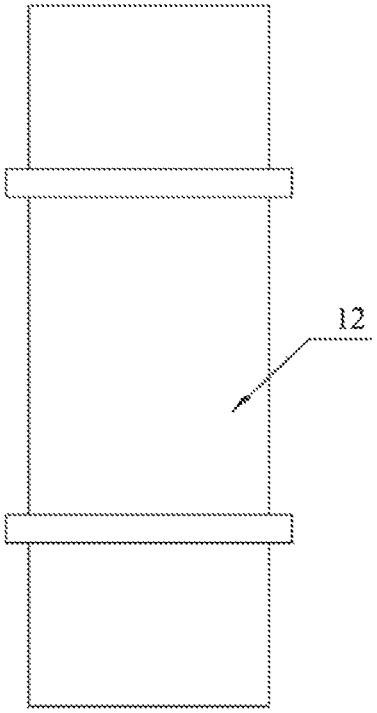
FIG. 6 is a side view of an inner sleeve pipe of a combined member of the present invention.

As shown in FIGS. 5 to 9, the end of the communication rod (1) is connected with a flange (1.1), an inner sleeve pipe (12), an outer sleeve pipe (13) or a transition sleeve pipe (14). As shown in FIG. 5, the flange 1.1 is welded at the end of the communication rod (1). As shown in FIGS. 6 to 9, the inner sleeve pipe (12) is a pipe of which the outer diameter is fitted with or slightly less than the inner diameter of the communication rod (1) and the pipe wall thickness of the inner sleeve pipe (12) is greater than that of the communication rod (1), and the weld of the end of the communication rod (1) and the inner sleeve pipe (12) is in an arc shape; the outer sleeve pipe (13) is a pipe of which the inner diameter is fitted with or slightly greater than the outer diameter of the communication rod (1), and the pipe wall thickness of the outer sleeve pipe (13) is greater than or equal to that of the communication rod (1); and the transition sleeve pipe (14) is a pipe of which the upper inner diameter is equal to or slightly greater than the outer diameter of a communication rod (1) of an upper layer and the lower outer diameter thereof is equal to or slightly less than the inner diameter of a communication rod (1) of a lower layer. The flanges (1.1) welded on the communication rods (1) of the upper and lower layers are butted against each other by bolts or welded with the communication rods (1) of the upper and lower layers by the inner sleeve pipe (12), the outer sleeve pipe (13) or the transition sleeve pipe (14), so that the communication rods (1) of the upper and lower layers can be connected and extend, wherein when the outer sleeve pipe (13) is adopted to connect the communication rods (1) of the upper and lower layers, the outer sleeve pipe (13) can be pre-fixed at the lower end of the communication rod (1) of the upper layer, and after installation, the outer sleeve pipe (13) is welded with the upper end of the communication rod (1) of the lower layer. When having different pipe diameters, the communication rods (1) of the upper and lower layers can be connected using the transition sleeve pipe (14), the upper end of the transition sleeve pipe (14) is sleeved on the outer wall of the lower end of the communication rod (1) of the upper layer, and the lower end of the transition sleeve pipe (14) is embedded in the communication rod (1) of the lower layer.

As shown in FIGS. 1A, 3, 4 and 10, in a preferred embodiment, the connector (2.2) of the connecting rod (2) is a fastening connector (3), the fastening connector (3) comprises a fastening portion (3.1) and connecting portions (3.2), wherein the connecting portions (3.2) are connected at both ends of the fastening portion (3.1) and extend in the direction away from the fastening portion (3.1), the shape of the inner surface of the fastening portion (3.1) is fitted with that of the outer surface of the connected communication rod (1), and the connecting portions (3.2) are provided with bolt holes.

As shown in FIGS. 1A and 4, when the connecting rod (2) is provided with a connector (2.2) arranged at the end of the rod body (2.1) and used as a fastening connector (3), one connecting rod (2) can be fastened with a connector (2.2) of the other connecting rod (2) arranged at the end of a rod body (2.1) on the same communication rod (1) by the connector (2.2) arranged at the end of the rod body (2.1) so that two connecting rods (2) and one communication rod (1) are connected to one another.

Figure 10:
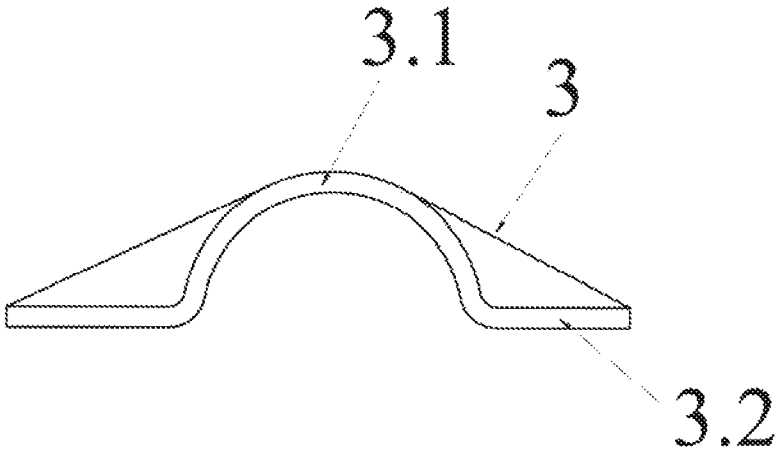
FIG. 10 is a side view of a single piece pairwise connected to a connector of the connecting rod in FIG. 1.
Figure 11:
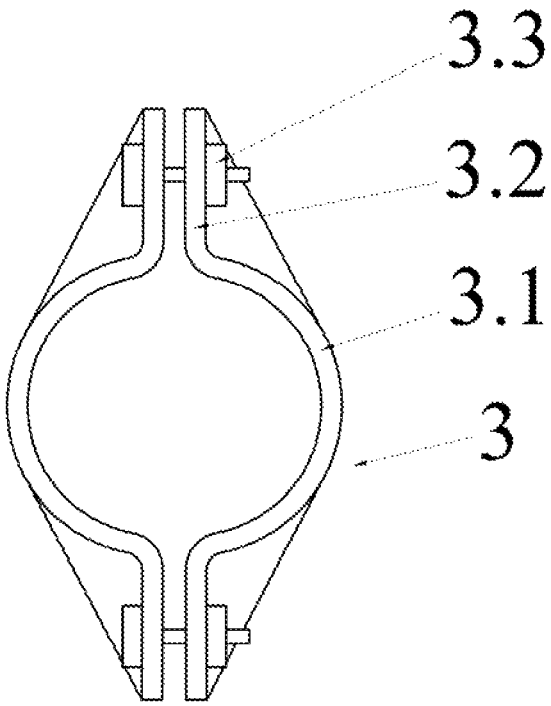
FIG. 11 is a schematic diagram of usage of a single piece connected to a fastening connector of a communication rod in a mutually fastening mode.
Figure 12A:
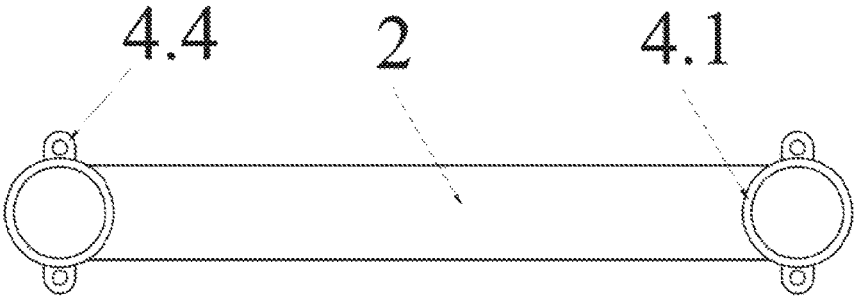
FIG. 12A is a top view of a connecting rod of a preferred embodiment of one of combined members of the present invention.
Figure 12B:
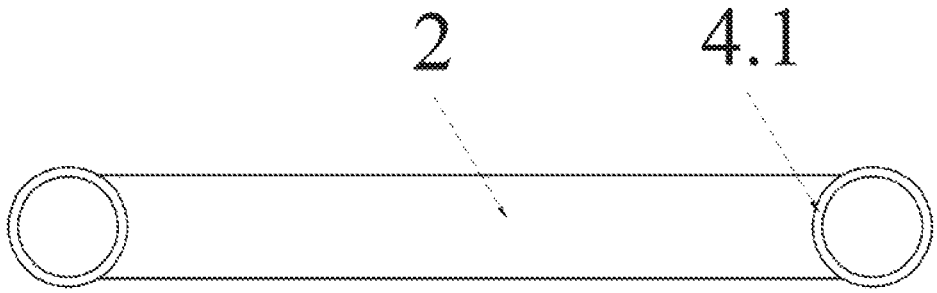
FIG. 12B is a top view of a connecting rod of a preferred embodiment of one of combined members of the present invention.
Figure 13A:
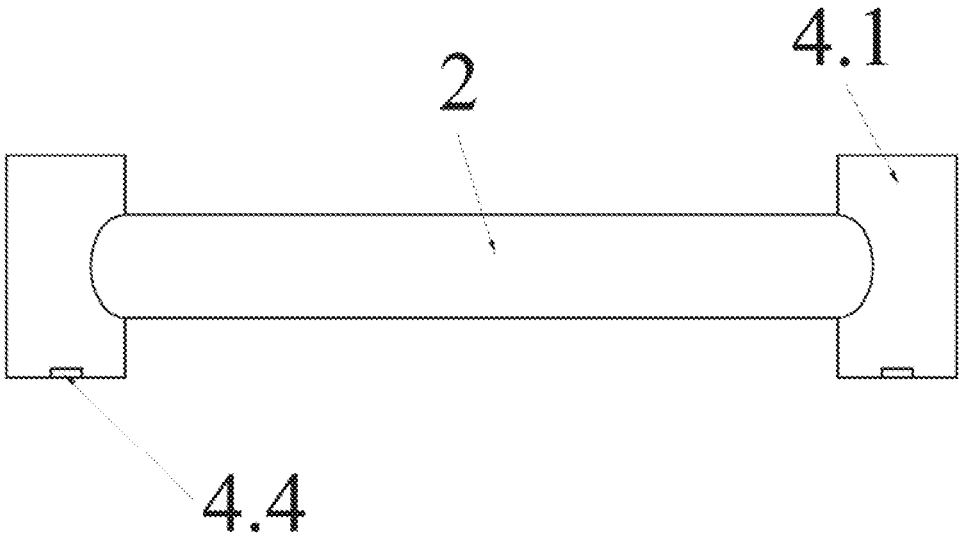
FIG. 13A is a side view of the connecting rod shown in FIG. 12A.
Figure 13B:
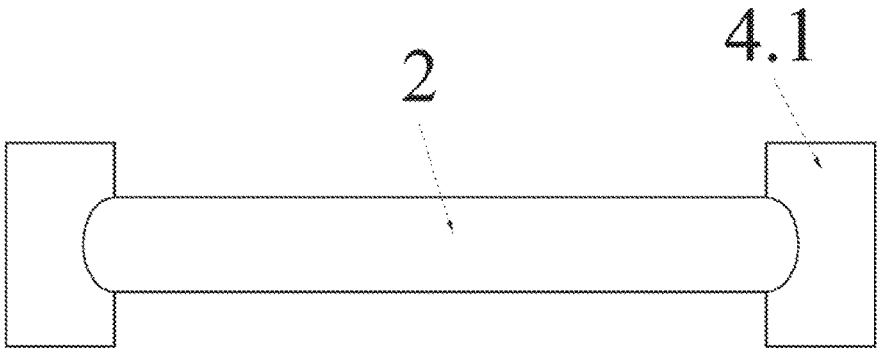
FIG. 13B is a side view of the connecting rod shown in FIG. 12B.

In addition, as shown in FIGS. 1A, 10 and 11, a single fastening connector (3) not connected to the rod body (2.1) of the connecting rod (2) is called a single piece, one connecting rod (2) can be fastened with the single piece by the connector (2.2) which is arranged at the end of the rod body (2.1) thereof and is used as a fastening connector (3) using a connecting piece (3.3), and is clamped on the communication rod to connect to the communication rod (1). The connecting piece (3.3) shown in FIG. 11 is a bolt, but is not limited to this.

As shown in FIGS. 7, 12A, 128, 13A, 13B and 14, in a preferred embodiment, the connector (2.2) of the connecting rod (2) is a sleeving connector (4). The sleeving connector (4) comprises an outer sleeve (4.1) fixedly connected to the rod body (2.1), an inner tight sleeve (4.2) sleeved outside the communication rod (1) and fitted with the outer sleeve (4.1) in a sleeving mode, and a tightening bolt (4.3) connected between the outer sleeve (4.1) and the inner tight sleeve (4.2), wherein the inner diameter of the outer sleeve (4.1) is gradually increased from top to bottom, the outer surface of the inner tight sleeve (4.2) is a conical surface and the outer diameter thereof is gradually increased from top to bottom, and the slope of the inner surface of the outer sleeve (4.1) is equal to that of the outer surface of the inner tight sleeve (4.2); the inner tight sleeve (4.2) is composed of two symmetrical arc cylinders; the inner diameter of the inner tight sleeve (4.2) composed of two symmetrical arc cylinders is equal to the outer diameter of the communication rod (1), the central angle of the symmetrical arc cylinders is slightly less than 180°, and the inner circumference combined by two arc surfaces is slightly smaller than a complete circumference; and the lower part of the outer sleeve (4.1) and the lower part of the inner tight sleeve (4.2) are respectively provided with an upper connecting lug (4.4) and a lower connecting lug (4.5), the upper connecting upper lug (4.4) and the lower connecting lug (4.) are provided with bolt holes corresponding to each other, and the tightening bolt is fixed in the bolt hole of the upper connecting lug (4.4) and the corresponding bolt hole of the lower connecting lug (4.5) in a penetration mode.

Figure 7:
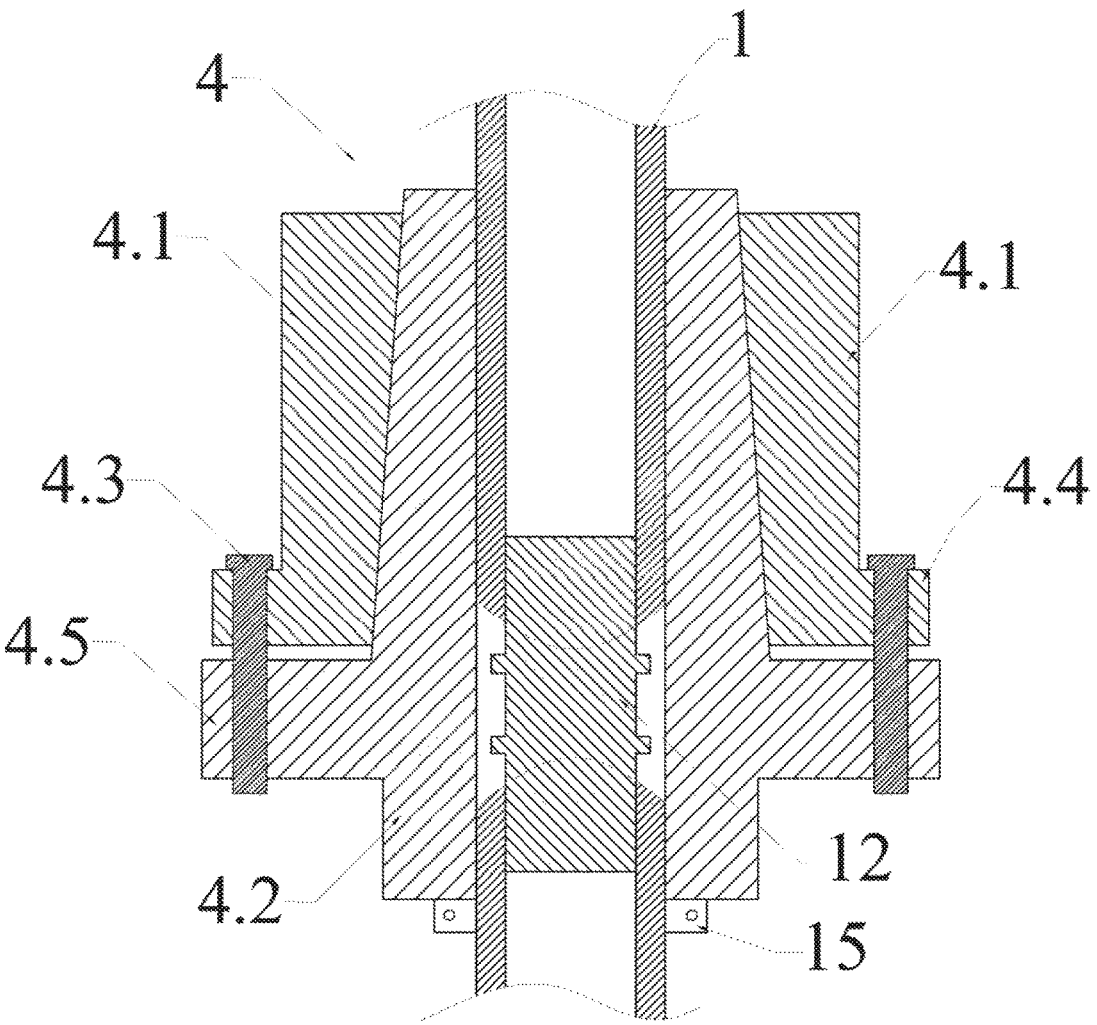
FIG. 7 is a side sectional view of a sleeving connector of a preferred embodiment of one of combined members of the present invention.
Figure 8:
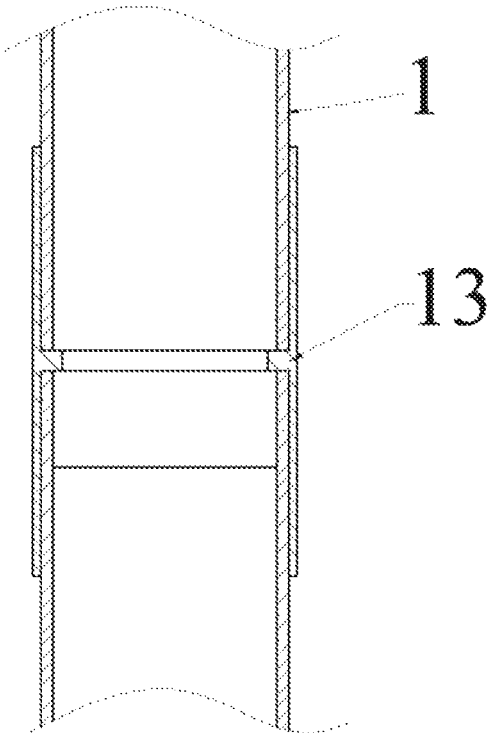
FIG. 8 is a schematic diagram of a usage state of an outer sleeve pipe of a combined member of the present invention.

As shown in FIG. 7, when the outer sleeve (4.1) is individually sleeved on the communication rod (1), the rod body (2.1) of the connecting rod (2) can be moved to any position on the communication rod (1) at random in the axial direction of the communication rod (1), and the gap between the outer sleeve (4.1) and the communication rod (1) is the thickness of the inner tight sleeve (4.2). When the outer sleeve (4.1) is moved to the side of the outer sleeve (4.1) with relatively large inner diameter along the axis of the communication rod (1), and the inner tight sleeve (4.2) is moved to the side of the outer sleeve (4.1) with relatively small outer diameter along the axis of the communication rod (1) at the same time, the inner surface (conical surface) of the outer sleeve (4.1) will force the inner tight sleeve (4.2) to contract by taking the communication rod (1) as a center. Meanwhile, relative positions of the outer sleeve (4.1) and the inner tight sleeve (4.2) are continually screwed or unscrewed using corresponding tensioning bolts (4.3), to guarantee the tight connection between the sleeving connector (4) and the communication rod (1).

Figure 15:
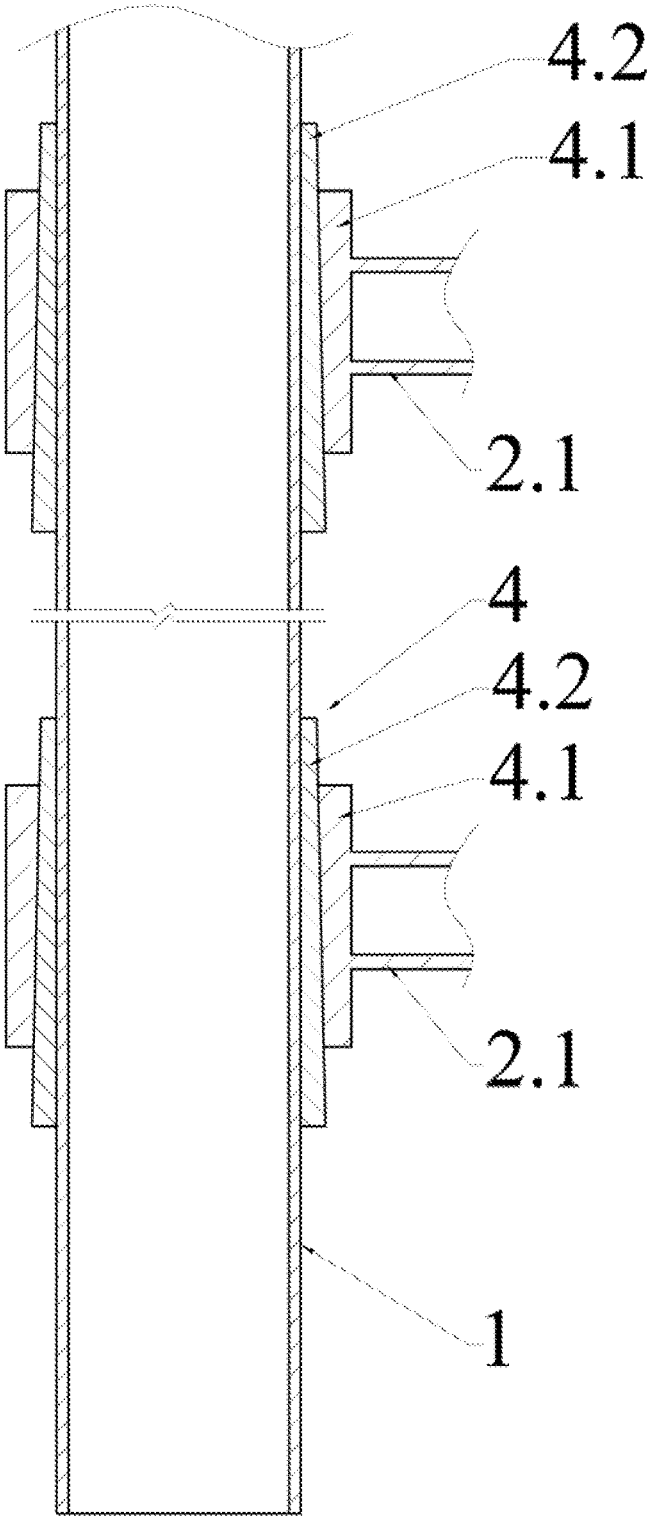
FIG. 15 is a schematic diagram of a usage state of a sleeving connector of a preferred embodiment of one of combined members of the present invention.
Figure 16:
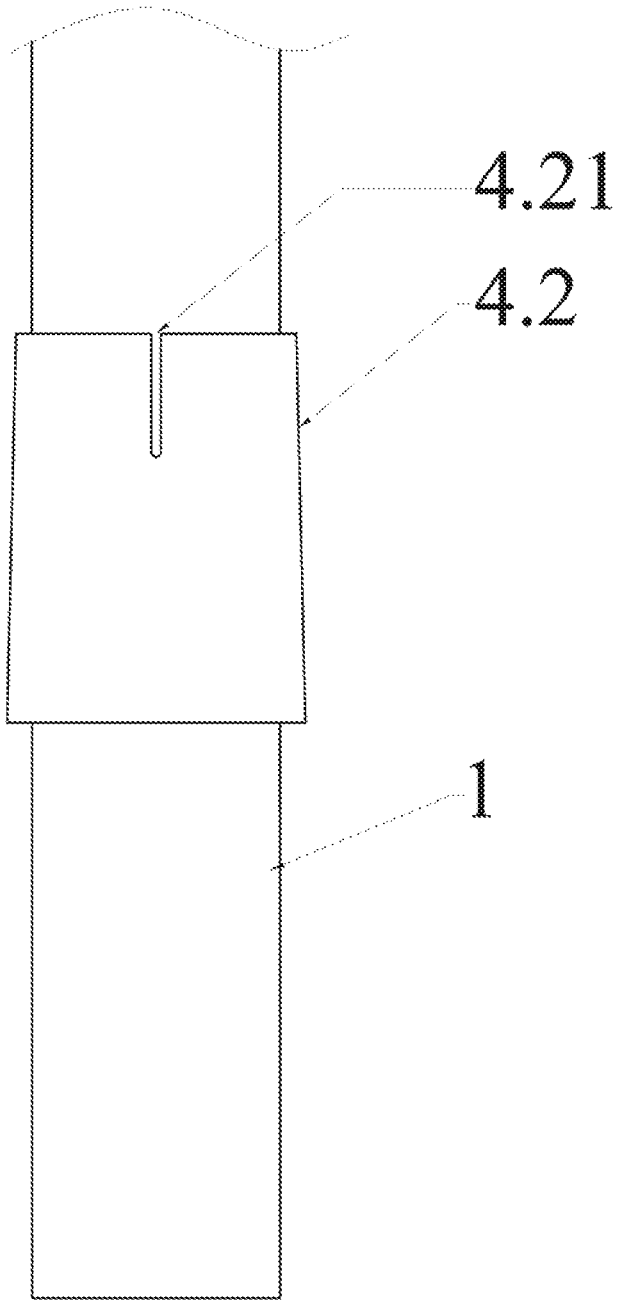
FIG. 16 is a side view of the inner tight sleeve shown in FIG. 15.

As shown in FIGS. 15 and 16, in a preferred embodiment, the connector (2.2) of the connecting rod (2) is a sleeving connector (4). The sleeving connector (4) comprises an outer sleeve (4.1) fixedly connected to the rod body (2.1), and an inner tight sleeve (4.2) sleeved outside the communication rod (1) and fitted with the outer sleeve (4.1) in a sleeving mode, wherein the inner tight sleeve (4.2) is a cylindrical; the inner diameter of the inner tight sleeve (4.2) is equal to or slightly greater than the outer diameter of the communication rod (1), and the inner tight sleeve (4.2) can be formed with a notch along an axial side surface thereof to conduct welding connection with the communication rod (1). When more than two layers of cylindrical inner tight sleeves (4.2) are arranged on the same communication rod (1), the maximum outer diameter of the inner tight sleeve (4.2) of the upper layer is less than the minimum inner diameter of the outer sleeve (4.1) fitted with the inner tight sleeve (4.2) of an adjacent lower layer.

Figure 14:
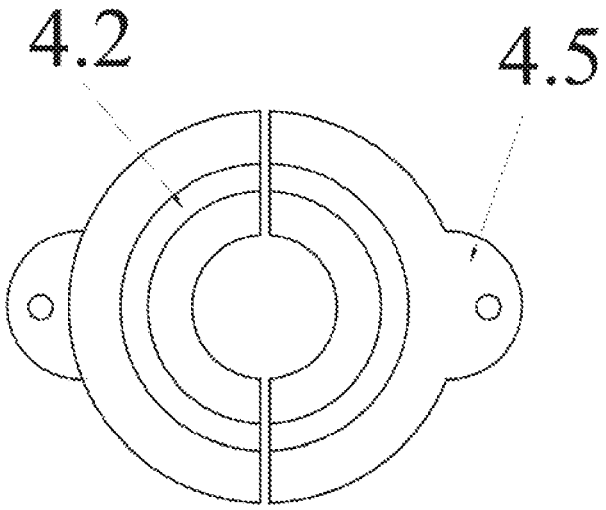
FIG. 14 is a top view of an outer sleeve and an inner tight sleeve of the sleeving connector shown in FIG. 7.
Figure 17:
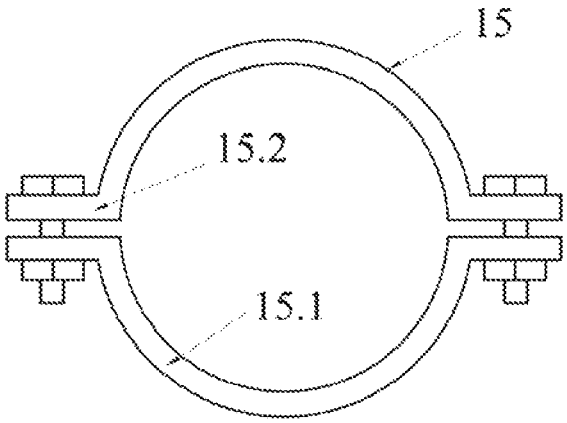
FIG. 17 is a top view of a locating ring shown in FIG. 7.
Figure 18A:
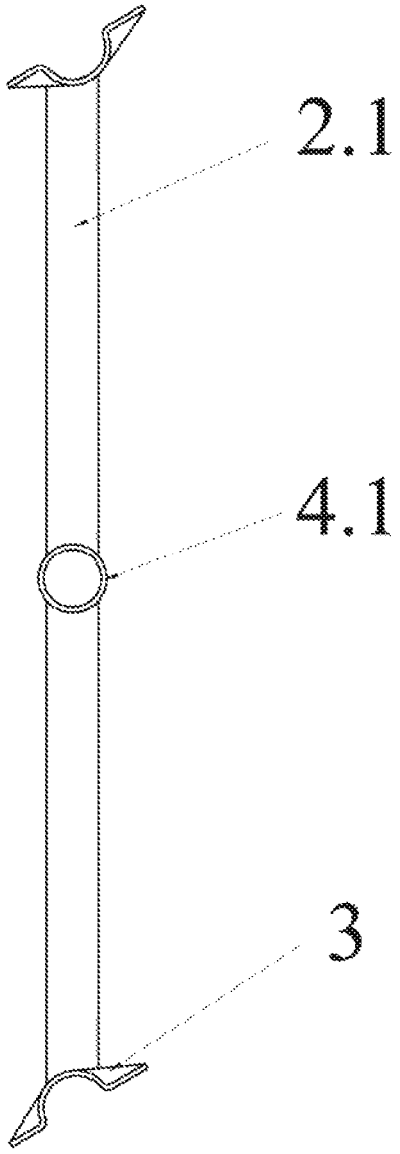
FIG. 18A is a top view of a connecting rod of a preferred embodiment of one of combined members of the present invention.
Figure 18B:
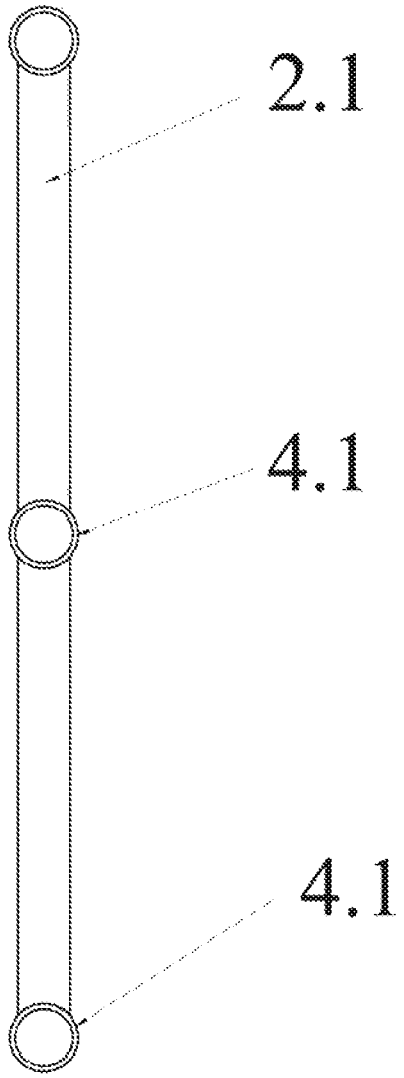
FIG. 18B is a top view of a connecting rod of a preferred embodiment of one of combined members of the present invention.
Figure 19:
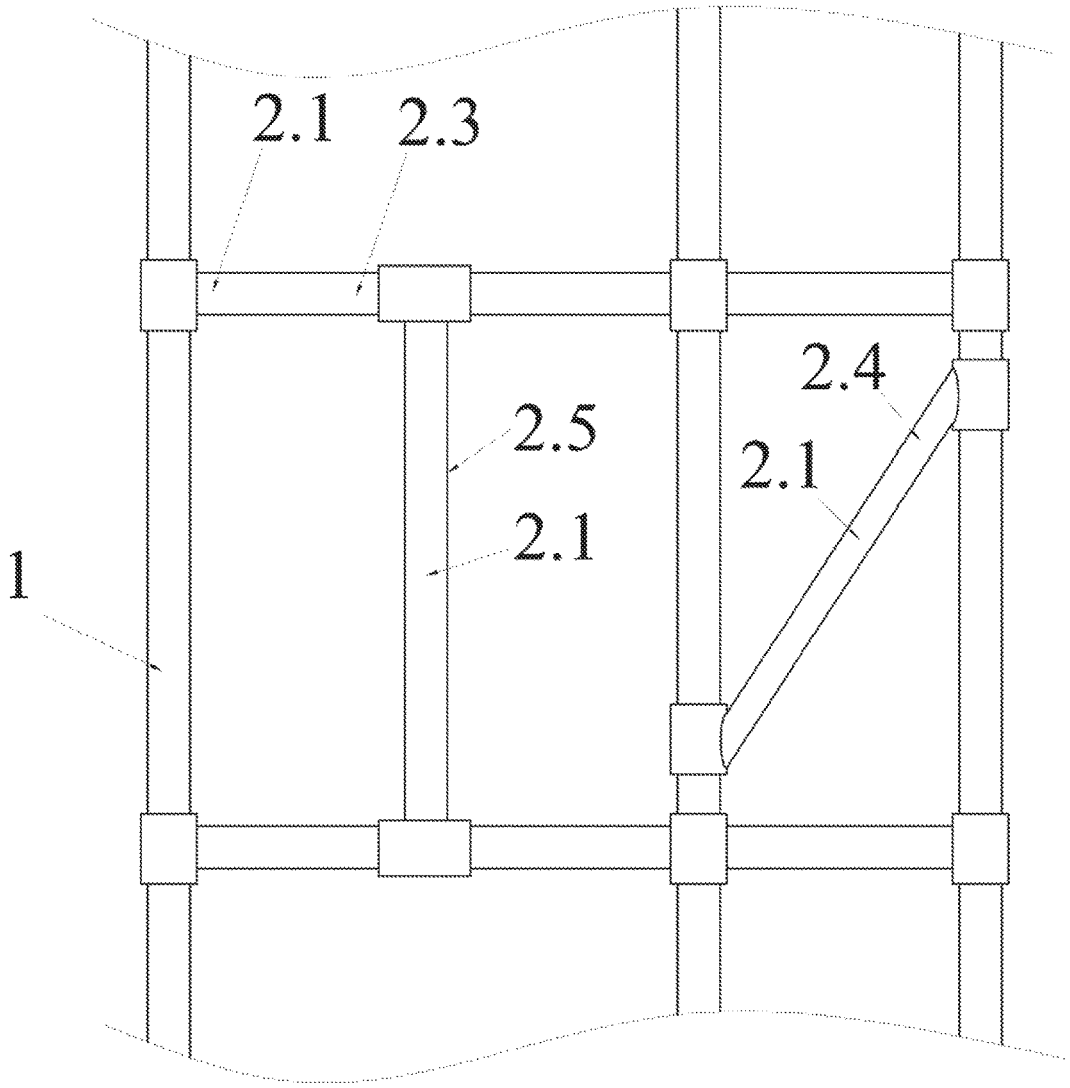
FIG. 19 is a schematic diagram of a usage state of communication rods and connecting rods of a combined member of the present invention.

As shown in in FIGS. 7, 14 and 17, in a preferred embodiment, the combined member also comprises a locating ring (15) which is arranged below the inner tight sleeve (4.2) and fastened outside the communication rod (1). The locating ring (15) comprises annular portions (15.1) and butting portions (15.2), wherein the annular portions (15.1) are arranged in the middle of the locating ring (15); the butting portions (15.2) are arranged at both sides of the annular portions (15.1) and extend to the two sides of the annular portions (15.1); the shape of the inner surface of each of the annular portions (15.1) is fitted with that of the outer surface of the connected communication rod (1); and the butting portions (15.2) are provided with bolt holes. The two half-surrounded annular portions (15.1) are clamped outside the communication rod (1), so that the sleeving connector (4) can be accurately located and installed on the design portion of the communication rod (1). Alternatively, in a preferred embodiment, the inner tight sleeves (4.2) are integratedly welded with the communication rod (1), so that there is no need of the locating rings (15), and the inner tight sleeves (4.2) can be connecting sleeve pipes of the communication rod (1).

Further, as shown in FIGS. 1A, 10, 12A, 18A and 18B, the communication rod (2) is provided with one rod body (2.1) and two connectors (2.2), or at least two rod bodies (2.1) and at least three connectors (2.2). When the communication rod (2) is provided with one rod body (2.1) and two connectors (2.2), both ends of the rod body (2.1) are respectively connected to the two connectors (2.2). When the communication rod (2) is provided with at least two rod bodies (2.1) and at least three connectors (2.2), i.e. the communication rod (2) is provided with multiple rod bodies and multiple connectors, the two rod bodies (2.1) are connected by the outer sleeve (4.1) of the sleeving connector (4), and each of the two ends of the communication rod (2) is provided with a sleeving connector (4) or a fastening connector (3).

Figure 9:
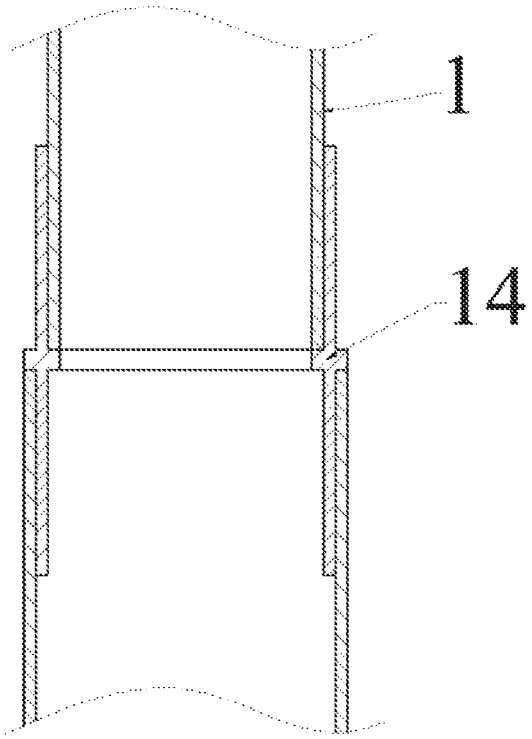
FIG. 9 is a schematic diagram of a usage state of a transition sleeve pipe of a combined member of the present invention.

For meeting the requirements of various connection modes, as shown in FIG. 3, in a preferred embodiment, the connecting rods (2) are divided into planar connecting rods (2.3) and inclined connecting rods (2.4). When each planar connecting rod (2.3) is connected to a communication rod (1), the axis of the rod body (2.1) thereof and that of the communication rod (1) are vertically connected to each other. When each inclined connecting rod (2.4) is connected to a communication rod (1), the included angle between the axis of the rod body (2.1) thereof and that of the communication rod (1) is less than 90°. As shown in FIG. 9, in a preferred embodiment, the connecting rods (2) are divided into planar connecting rods (2.3), vertical connecting rods (2.5) and inclined connecting rods (2.4). When each vertical connecting rod (2.5) is connected to a planar connecting rod (2.3), the axis of the rod body thereof and that of the planar connecting rod (2.3) are vertically connected to each other. The vertical connecting rods (2.5) can be used as connecting rods between the planar connecting rods (2.3) of the upper layer and the lower layer locally in the same direction, so as to form a truss beam, thereby shortening the node space between the rods, and enhancing rigidity and stability. In a preferred embodiment, as shown in FIG. 3, when each inclined connecting rod (2.4) is connected to a communication rod (1), the included angle between the axis of the rod body thereof and that of the communication rod (1) is 45°.

Further, as shown in FIGS. 1A to 1E, when the connector (2.2) of the connecting rod (2) is the fastening connector mentioned above in FIGS. 10 and 11, the included angle between the axis of the rod body (2.1) of the connecting rod (2) and the plane where the connecting portion of the fastening connector (3) thereof is located can be any angle. In a preferred embodiment, the included angle is 30°, 45°, 60° or 90°, but is not limited to this.

Figure 20:
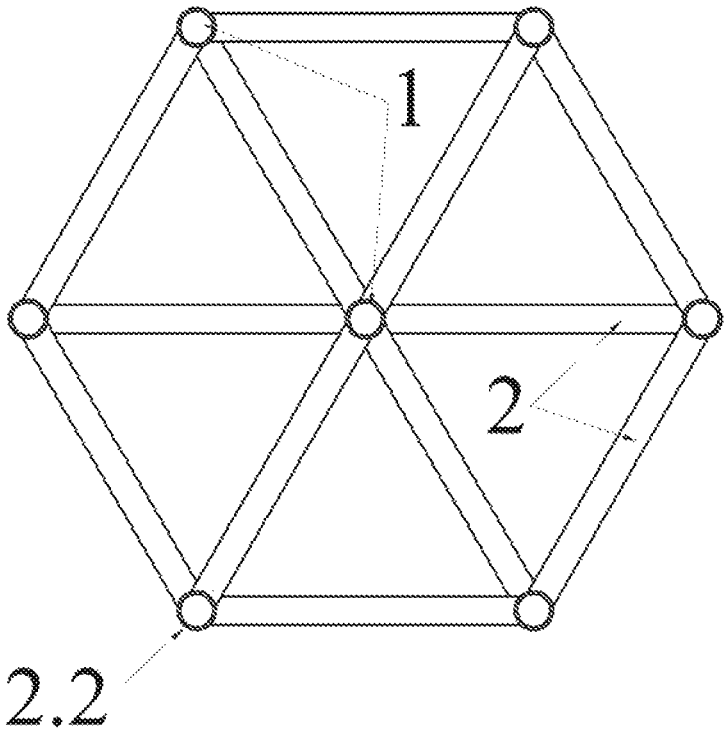
FIG. 20 is a top view of a hexagonal stable support provided with a siamesed device in a cut-off communication rod form at the center.
Figure 21:
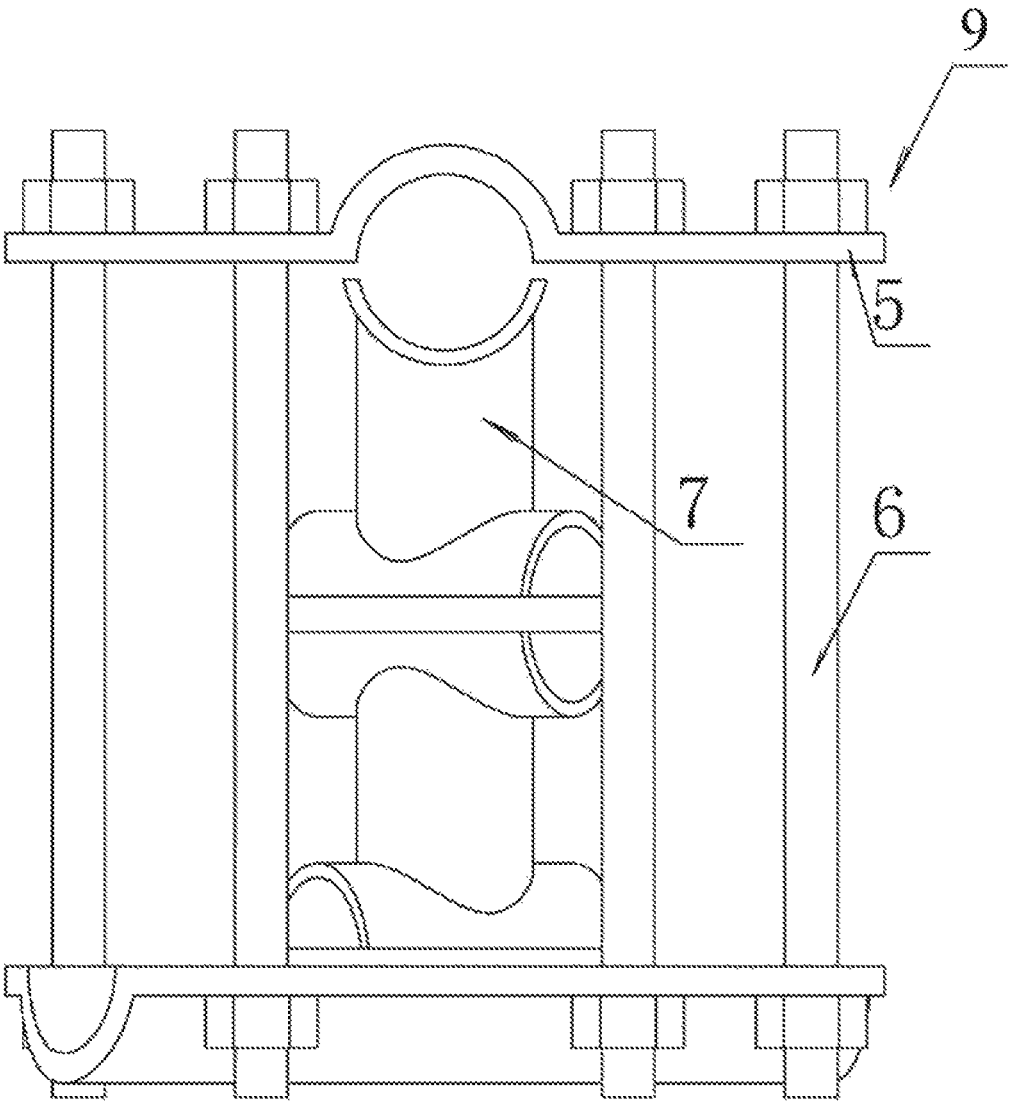
FIG. 21 is a side view of a supporting plate siamesed device of a combined member of the present invention.
Figure 22:
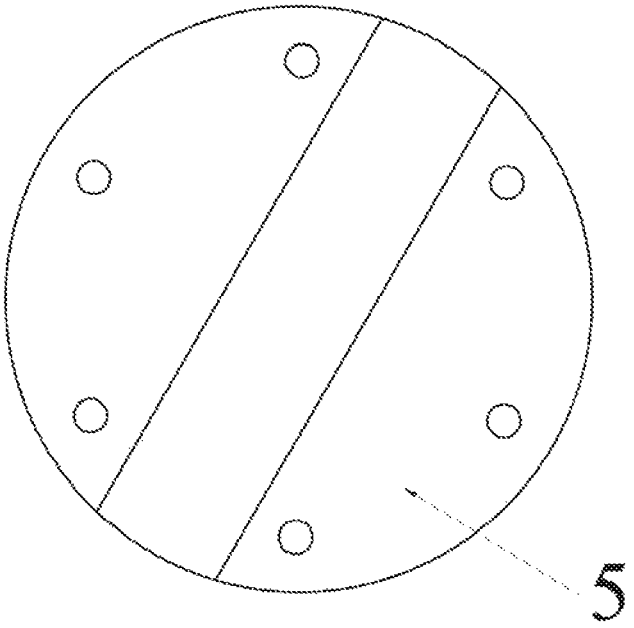
FIG. 22 is a top view of connecting supporting plates shown in FIG. 21.

The combined member also comprises siamesed devices (9). The siamesed devices (9) have the following two forms:

as shown in FIG. 20, in a preferred embodiment, the siamesed device (9) is in the form of a cut-off communication rod, that is, the communication rod (1) is cut off locally, so that six adjacent regular-triangle columns taking the axis of the locally cut-off communication rod (1) as a center form a regular-hexagon column-shaped frame structure, but the joint between the locally cut-off communication rod (1) and a connecting rod (2) is still retained, and three adjacent layers of connecting rods in different directions are integratedly connected; and as shown in FIGS. 21 to 25, in a preferred embodiment, the siamesed device (9) is a supporting plate siamesed device which comprises upper and lower connecting supporting plates (5), connecting bolts (6) for connecting the upper and lower connecting supporting plates (5), and bearing blocks (7) arranged between the upper and lower connecting supporting plates (5) and used for rigidly connecting two adjacent layers of connecting rods (2) in different directions.

As shown in FIGS. 21 to 25, the bearing block (7) comprises a middle supporting rod and upper and lower supporting grooves, wherein the upper and lower supporting grooves are respectively sleeved outside the upper and lower connecting rods; the included angle between the projections of the axis of the upper supporting groove and the axis of the lower supporting groove in the axial direction of the communication rod (1) is 60°; the upper and lower supporting grooves are of a half-surrounded groove structure, and the shape of the inner groove surface of each supporting groove is fitted with the that of the outer surface of the connected connecting rod (2); and the middle supporting rod is a column, and both ends of the middle supporting rod are respectively connected to the middle portion of the lower surface of the upper supporting groove and the middle portion of the upper surface of the lower supporting groove.

When any of communication rods (1) is replaced with the supporting plate siamesed device, the connectors (2.2) of the planar connecting rods (2.3) which are originally connected to the communication rods (1) may be omitted, so that the rod bodies (2.1) of the planar connecting rods (2.3) which are originally connected to the communication rods (1) are connected by the supporting plate siamesed device, and so that the rod bodies (2.1) of three adjacent layers of connecting rods (2.3) in different directions are integratedly connected longitudinally by the supporting plate siamesed device.

Figure 26:
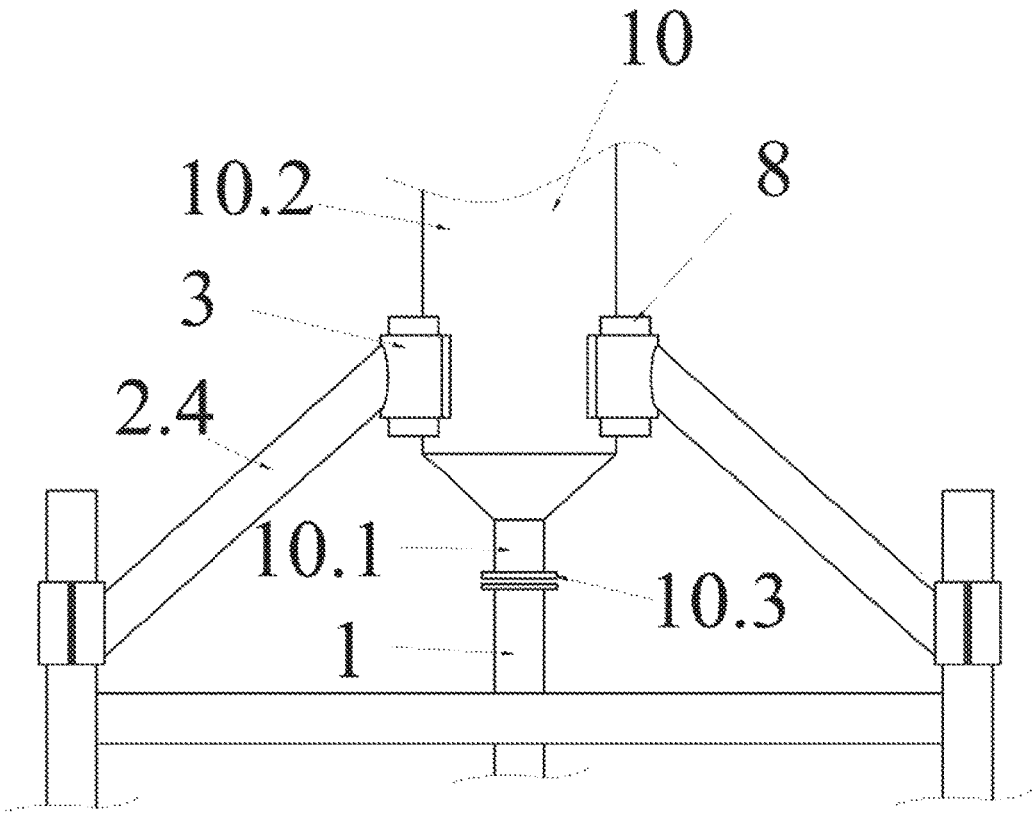
FIG. 26 is a local side view of a variable-diameter union of a combined member of the present invention.
Figure 27:
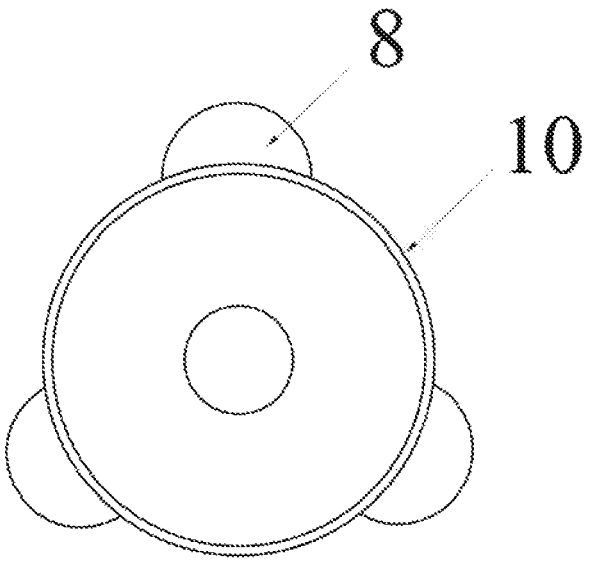
FIG. 27 is a top view of the variable-diameter union shown in FIG. 26.

As shown in FIGS. 26 and 27, in a preferred embodiment, the combined member also comprises a variable-diameter union (10) for the diameter variation extension of the communication rod (1), i.e. a variable-diameter union (10) for connecting the original-diameter and diameter post-variation communication rods (1), wherein the variable-diameter union (10) comprises an original-diameter connecting pipe (10.1), a diameter post-variation connecting pipe (10.2) and fastening connector plinths (8) arranged on the side surfaces of the union, the original-diameter connecting pipe and the diameter post-variation connecting pipe being respectively used for connecting to the original-diameter and variable-diameter communication rods, the fastening connector plinths (8) being connected to the fastening connectors (3) of the original-diameter connecting rods (2.4), and the fastening connector plinths (8) being connected to the adjacent diameter pre-variation communication rods (1) by the original-diameter connecting rods (2.4); and further, the original-diameter connecting pipe (10.1) is provided with an original-diameter flange (10.3), the diameter post-variation connecting pipe (10.2) is provided with a diameter post-variation flange (not shown in the figure), and the variable-diameter union (10) is provided with three fastening connector plinths (8), but is not limited to this. In a preferred embodiment, the variable-diameter union (10) is provided with six fastening connector plinths (8), wherein the three or six fastening connector plinths (8) are uniformly arranged along the outer peripheral surface of the variable-diameter union (10); if the outer peripheral surface is not large enough to arrange the six fastening connector plinths, the six fastening connector plinths (8) can be arranged along the axis of the variable-diameter union (10) at layers, and the six fastening connector plinths (8) are uniformly distributed along the projection of the axis of the variable-diameter union (10); each fastening connector plinth (8) is provided with a screwed bolt hole corresponding to a bolt hole of each fastening connector (3) of the original-diameter inclined connecting rods (2.4) so as to form relative combination; the size of the variable-diameter planar connecting rods (2.3) and the size of the original-diameter planar connecting rods (2.3) are exponentially amplified; and the purpose of diameter variation is to change the available space inside a support. This structure is beneficial to reduce the material costs of the lower support. For connecting the connecting rod (2) as a standard part to the communication rod (1) with an amplified diameter (the variable-diameter communication rod (1)), the side wall of the communication rod (1) with an amplified diameter is provided with three fastening connector plinths (8) in an equal diversion mode in the same horizontal plane.

Figure 28:
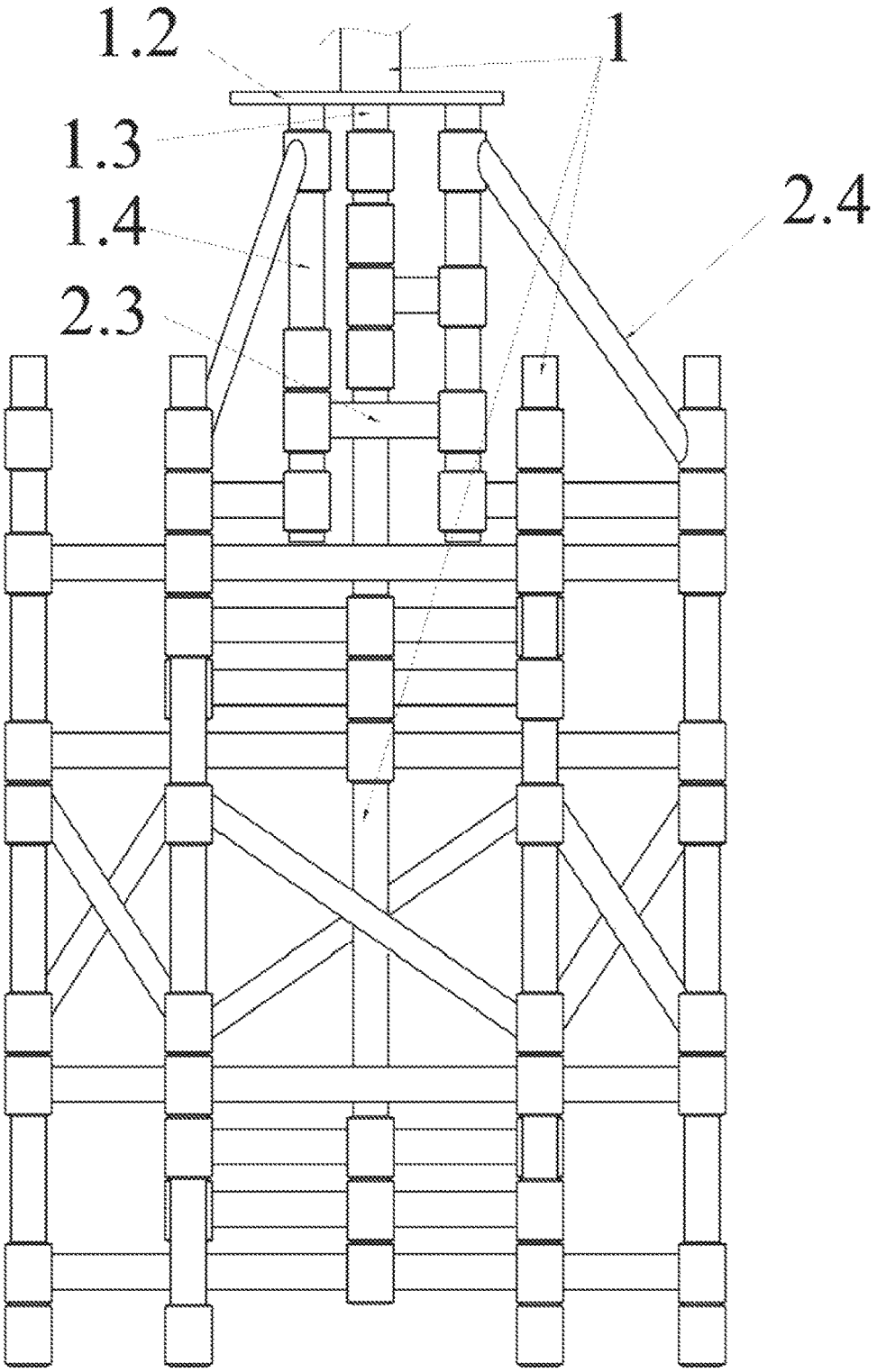
FIG. 28 is a schematic diagram of a usage state of the other variable-diameter union of a combined member of the present invention.
Figure 29:
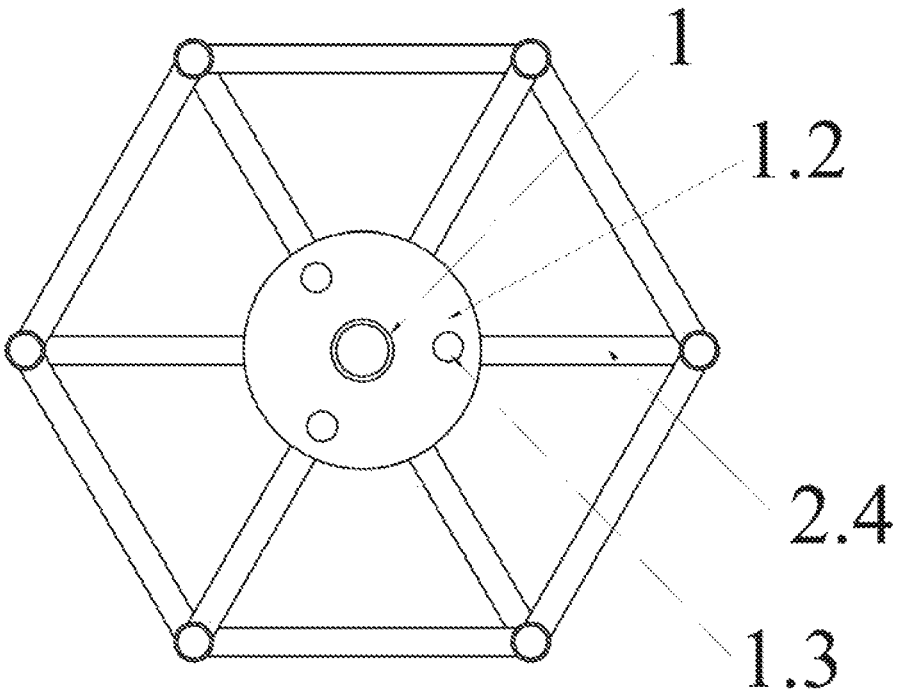
FIG. 29 is a top view of FIG. 28.

As shown in FIGS. 28 and 29, in a preferred embodiment, the combined member can comprise a variable-diameter connecting unit for connecting the variable-diameter and diameter post-variation communication rods (1), wherein the variable-diameter connecting unit comprises a variable-diameter base (1.2) arranged at the bottom end of the variable-diameter communication rod (1), original-diameter central communication rods (1.3) which are fixedly connected to the variable-diameter base (1.2) by each upper end thereof and are coaxial with the variable-diameter communication rod (1), and three original-diameter reinforced communication rods (1.4) which are fixedly connected to the variable-diameter base (1.2) by each upper end thereof and are uniformly distributed around the central communication rods (1.3), the central communication rods (1.3) and the reinforced communication rods (1.4) being connected to each other by the connecting rods (2) and being connected to the original-diameter communication rod (1) to form a stable whole. Further, as shown in FIG. 29, the original-diameter communication rod (1) forms a stable structure unit of which the cross section is in the shape of a regular hexagon by the connecting rods (2); the original-diameter central communication rods (1.3) are fixedly connected to the original-diameter communication rod (1) located in the center of the stable structure unit by a flange; the original-diameter central communication rods (1.3) and the original-diameter reinforced communication rods (1.4) are pairwise connected to form a whole by the planar connecting rods (2.3); and the original-diameter reinforced communication rods (1.4) are connected to the original-diameter communication rods (1) located on the periphery of the stable structure unit by the planar connecting rods (2.3) and the inclined connecting rods (2.4), so that the diameter post-variation communication rods (1) form a stable whole together with the stable structure unit. In a preferred embodiment, the variable-diameter connecting unit comprises six original-diameter reinforced communication rods (1.4), but is not limited to this.

Figure 23:
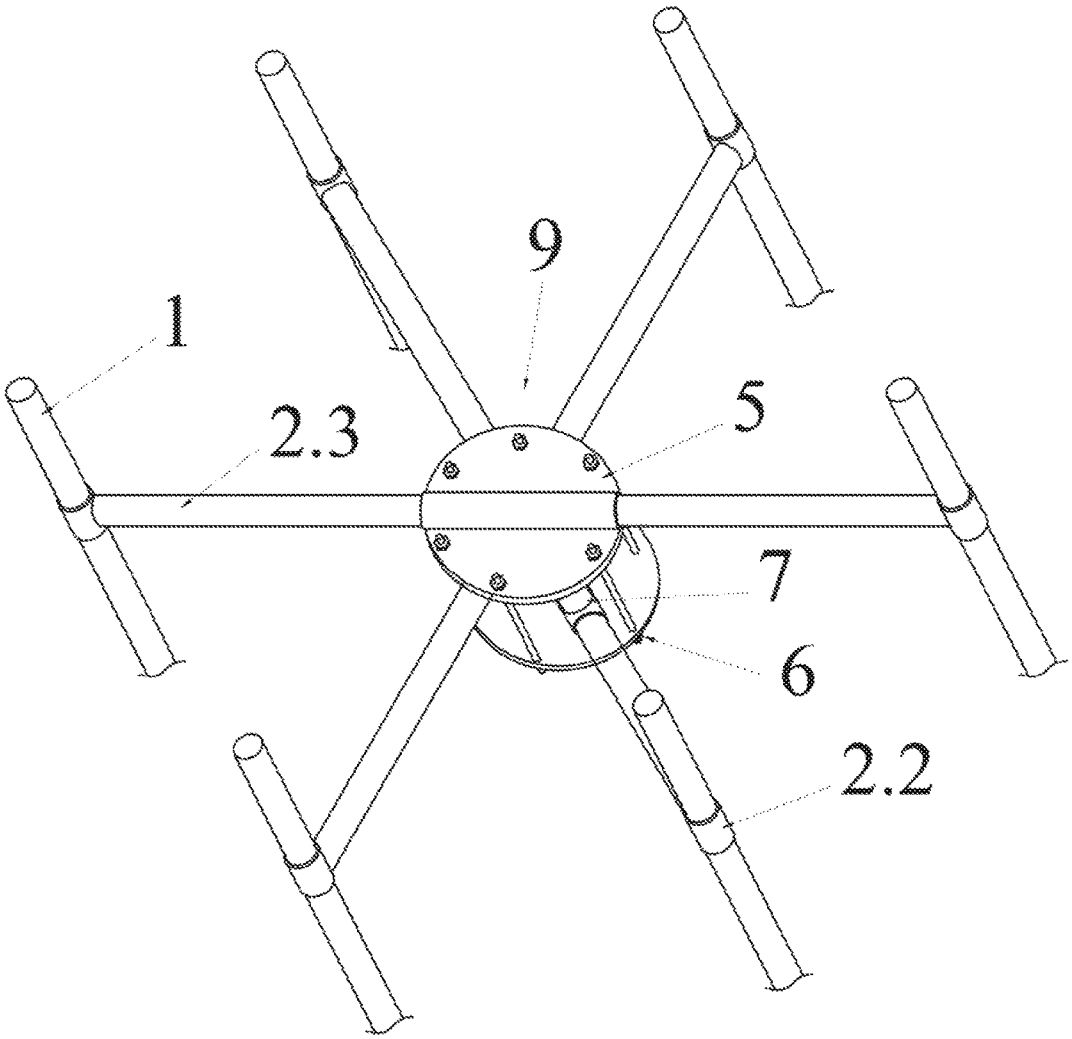
FIG. 23 is a schematic diagram of a usage state of the supporting plate siamesed device shown in FIG. 21.
Figure 24:
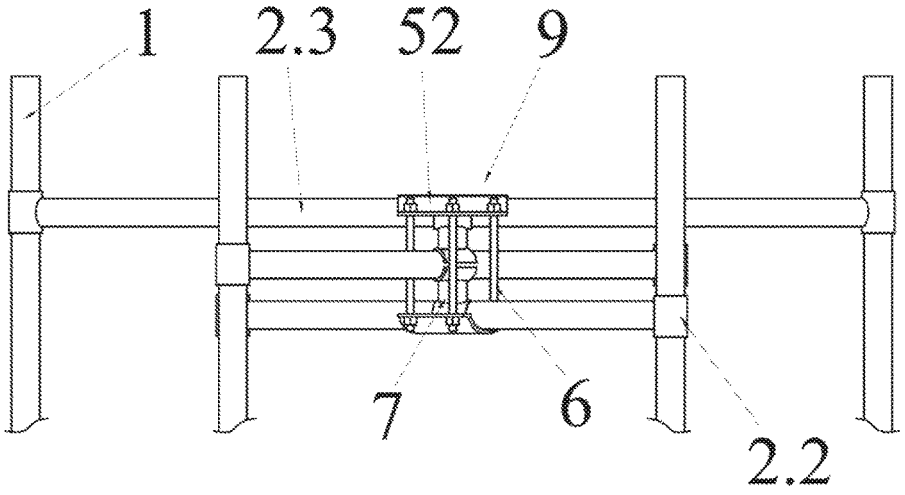
FIG. 24 is a side view of FIG. 23.
Figure 25:
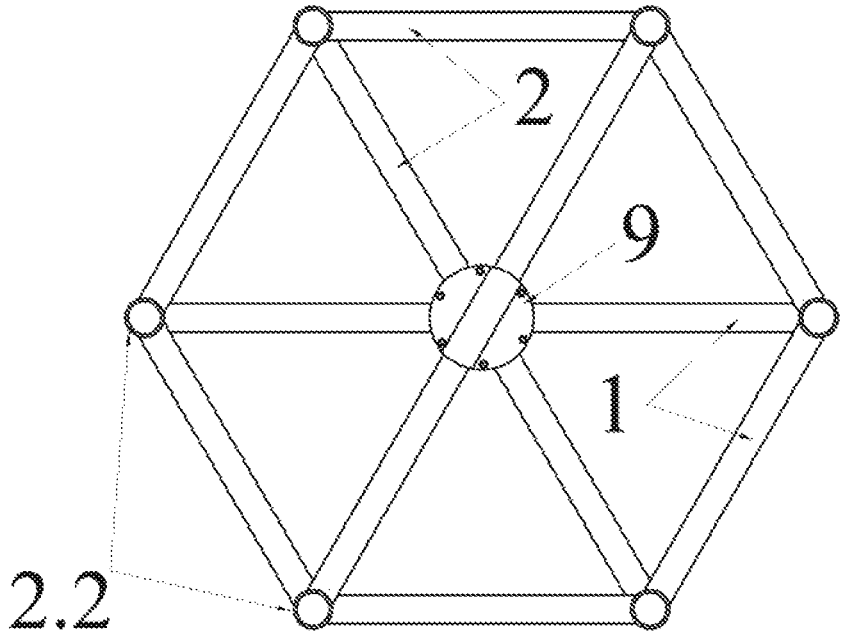
FIG. 25 is a top view of FIG. 23.

As shown in FIGS. 3, 4, 20, 23 to 25 and 30, each element of the combined member of the present invention is made into a standard part in advance, the connectors (2.2) of the adjacent connecting rods (2) are fixedly connected to the communication rods (1), so as to form a stable support of a regular-triangle column-shaped frame structure or a regular-hexagon column-shaped frame structure by taking the projections of the connecting rods (2) in the axial directions of the communication rods (1) as three sides of a regular triangle or six sides of a regular hexagon and locating the communication rods (1) at three angles of the regular triangle or six angles of the regular hexagon; and the communication rod (1) which is connected in the connector (2.2) is concentric with the connector (2.2). As shown in FIGS. 23 to 25, when the projections of the connecting rods (2) in the axial direction of the communication rods (1) form a regular hexagon, a planar connecting rod (2.3) is connected between every two communication rods (1) on the diagonal, thereby forming a regular-hexagon column-shaped frame structure. In a preferred embodiment, as shown in FIGS. 3 and 4, the connector is a fastening connector (3).

A stable support of the present invention formed by the combined member is characterized in that the axis of each connecting rod (2) intersects the that of each communication rod (1) connected thereto, the projections of the connecting rods (2) in the axial directions of the communication rods (1) are in the shape of a triangular mesh, the optimal form is the shape of a regular-triangle mesh, the projections of the communication rods (1) are nodes of the regular-triangle mesh, the projections of the connecting rods (2) are the sides of the regular-triangle mesh, and the connecting rods (2) include planar connecting rods (2.3) and inclined connecting rods (2.4), wherein the projections of the adjacent planar connecting rods (2.3) of which the axes are mutually perpendicular to those of the communication rods (1) form a complete triangular mesh, thereby forming a planar stable structure, the axis of each inclined connecting rod (2.4) and the axis of each communication rod (1) form a certain included angle, and the inclined connecting rods (2.4) form the stable support together with the above-mentioned planar stable structure. In a preferred embodiment, the included angle between the axis of the inclined connecting rod (2.4) and the axis of the communication rod is 45°.

As shown in FIGS. 20, 23 to 25 and 30, when the stable support is of a regular-hexagon column-shaped frame structure, the center of each of three diagonal connecting rods is also connected to the central communication rod (1) (see FIG. 20) or the supporting plate siamesed device (9) (see FIGS. 23 to 25). Further, the stable support comprises at least two connecting rod groups and six communication rods (1), wherein each connecting rod group is composed of nine connecting rods (2); the projection of the connecting rod group in the extension directions of the communication rods is in the shape of a regular hexagon, the interior thereof is equally divided into six regular triangles (see FIGS. 20 and 25), and the connecting rods of which the extension directions are parallel to each other in the same connecting rod group are located in the same plane (such as planes a, b and c in FIG. 30); and the six communication rods (1) are parallel to each other and are perpendicular to the axes of all the connecting rods (2), and each communication rod (1) is inserted and located in the connector 2.2 at the end of each connecting rod (2).

As shown in FIG. 20, central communication rods (1) of the stable support unit are parallel to six communication rods (1), and are located among the six communication rods (1), and the central communication rods (1) are connected to the six communication rods (1) by the connecting rods (2), thereby forming the stable support unit.

As shown in FIGS. 20 and 23 to 25, the communication rod (1) in the local position of the stable support unit can be replaced with a siamesed device (9); and as shown in FIGS. 26 and 27, the communication rod 1 can also change a pipe diameter by the variable-diameter union (10), and correspondingly change the specification and size of the connecting rod (2), so that the size of a space in the support in the axial direction of the communication rod (1) can be changed, thereby meeting different requirements.

As shown in FIGS. 4 and 10, when the communication rod (1) and the connecting rod (2) are circular pipes, the cross section of the fastening portion (3.1) of the fastening connector (3) is in the shape of a semicircular ring. When the communication rod (1) and the connecting rod (2) are connected and fixed by the fastening connector (3), the internal diameter of the fastening portion (3.1) is consistent with the external diameter of the communication rod (1), but the inside circumference of the fastening portion (3.1) is slightly less than the half of the outer circumference of the communication rod (1). At this moment, the fastening connector (3) has the mode or feature of connecting the rods that the fastening connector (3) fixed to the end of the rod body (2.1) of the connecting rod is fastened with the fastening connector (3) at the end of the rod body (2.1) of the other connecting rod or an independent fastening connector (3), and is fixed by fastening a bolt assembly. The two fastened fastening connectors (3) form a pipe sleeve of which the internal diameter is consistent with the external diameter of the communication rod (1), and clamp the communication rod (1) fastened thereto. Since the inside circumference of the fastening portion (3.1) is slightly less than the half of the outer circumference of the communication rod (1) fastened thereto, the inner circumference of the two fastened fastening connectors (3) is less than the outer circumference of the communication rod (1), and the inner side of the fastening portion (3.1) is tightly attached to the outer wall of the communication rod (1) fastened thereto, and therefore, when the two fastened fastening connectors (3) are tightened by the fastening bolt assembly, not only the pressure of the fastening portion (3.1) of the fastening connector (3) on the communication rod (1) fastened thereto is increased, but also there is a trend to reduce the inner circumference of the two fastened fastening connectors (3), so that the frictional force of the joint between the fastening connector (3) and the communication rod (1) is increased at a geometric level. The inner cavity of the pipe sleeve formed by the two fastened fastening connectors (3) and the periphery of the communication rod (1) fastened thereto form a tight fitting space, and any change in the angle of the relative connection thereof can form a trend to increase the frictional force. Moreover, the axis of the connected connecting rod (2) intersects that of the communication rod (1), which is beneficial to the transfer of force, and in the process of force transfer, the fastening connector (3) does not generate a torsional moment, and a larger axial stress can be transferred. When the rod bodies (2.1) of two connecting rods are connected and fixed, the fastening connector (3) has the same connection mode and principle as the above-mentioned fastening connector (3) when connecting and fixing the communication rod (1) with the rod body (2.1) of the connecting rod.

Generally, the length of the connector (2.2) is much larger than the depth of the cross section of the rod body (2.1) of the connecting rod, and the material and thickness of the connector (2.2) can be better than those of the rod body (2.1) of the connecting rod. It is preferred to integratedly connect the rod body (2.1) of the connecting rod with the connector 2.2 by welding, and at this moment, the rod body (2.1) of the connecting rod is welded with the connector (2.2) in a free state, so that it is easy to accurately control the size, and the harmful residual stress formed by welding is small, and the welding process is irrelevant to the communication rod (1), so that the integrity of the material structure of the communication rod (1) is not damaged, and it is also easy to conduct large-scale industrial production.

Therefore, it is decided that the standard production in the factory can be conducted on each element by each element of the combined member of the present invention and the connection form thereof, and the quick assembling can be realized using no re-welding or using little welding on site (only when a sleeving connector (4) is used, during the connection of the communication rods, there is need to weld the inner sleeve pipe (12) on site). The mechanical property of the support is even better than that of the connection form of directly welding rods.

Figure 31:
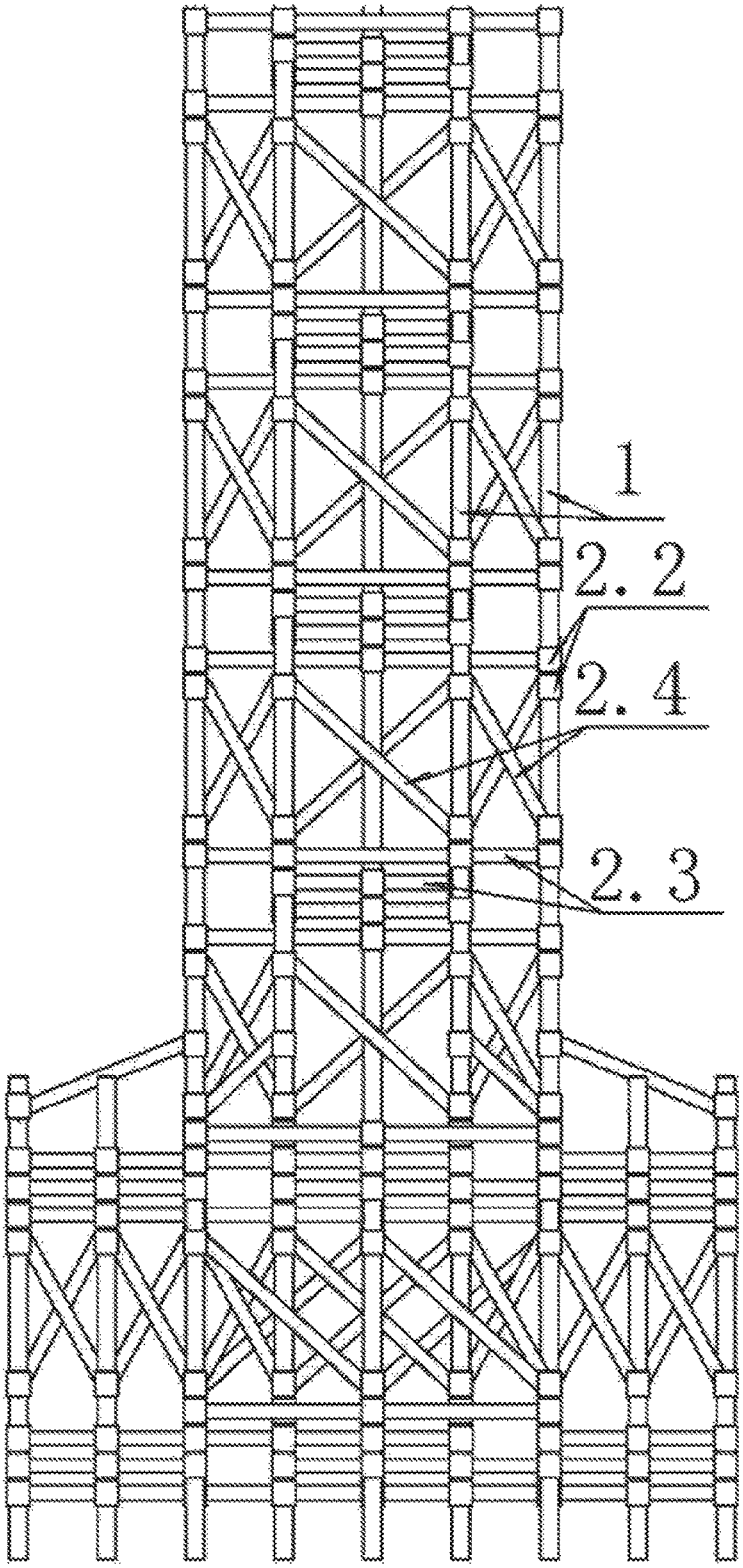
FIG. 31 is a local side view of a tower constructed by hexagonal stable supports of embodiment 1 of the present invention.

Embodiment 1: A Tower Constructed by Hexagonal Stable Supports of the Present Invention As shown in FIG. 31, a tower is composed of a main frame body and an outward extension base which is arranged below the main frame body.

The main frame body is a hexagonal column-shaped frame-type tower which is composed of a multi-layer hexagonal frame arranged horizontally and composed of connecting rods (2.3) arranged in a plane, and six communication rods (1) arranged in the mode of longitudinal extension, used for supporting the connecting rods (2.3) and mutually connected to the connecting rods (2.3). For enhancing the stability of the tower, the connecting rods (2.4) are also connected to the side surfaces of the communication rods (1) and between the adjacent communication rods (1). The vertical projection of the main frame body has an external profile in the shape of a regular hexagon, and the interior of the regular hexagon is divided into six regular triangles by three diagonal lines.

Based on the main frame body, below the main frame body, in accordance with the above-mentioned connection mode, the outward extension base connects and supports the connecting rods (2.3) to the communication rods (1), so that the connecting rods (2) extend outwards in the horizontal direction to form a regular triangle.

The vertical projection of the tower of the embodiment has an external profile in the shape of a regular hexagon, and the interior of the regular hexagon is equally divided into twenty four regular triangles.

Further, the communication rods form a vertical support structure of a main frame body. A plurality of main planar connecting rods (2.3) located in different horizontal planes form a multi-layer horizontal connection structure of the main frame body so as to connect and fix the communication rods together. The inclined connecting rods (2.4) arranged between every two adjacent planar connecting rods (2.3) form a vertical connection structure of the main frame body. The vertical support structure, the horizontal connection structure and the vertical connection structure of the main frame body form the main body of the tower with a stable structure. The communication rods (1) located on the outward extension base are accurately connected to the main frame body under the cooperative connection between the planar connecting rods (2.3) on the outward extension base and the inclined connecting rods (2.4) on the outward extension base.

Therefore, a tower structure with a stable foundation is formed.

Figure 30:
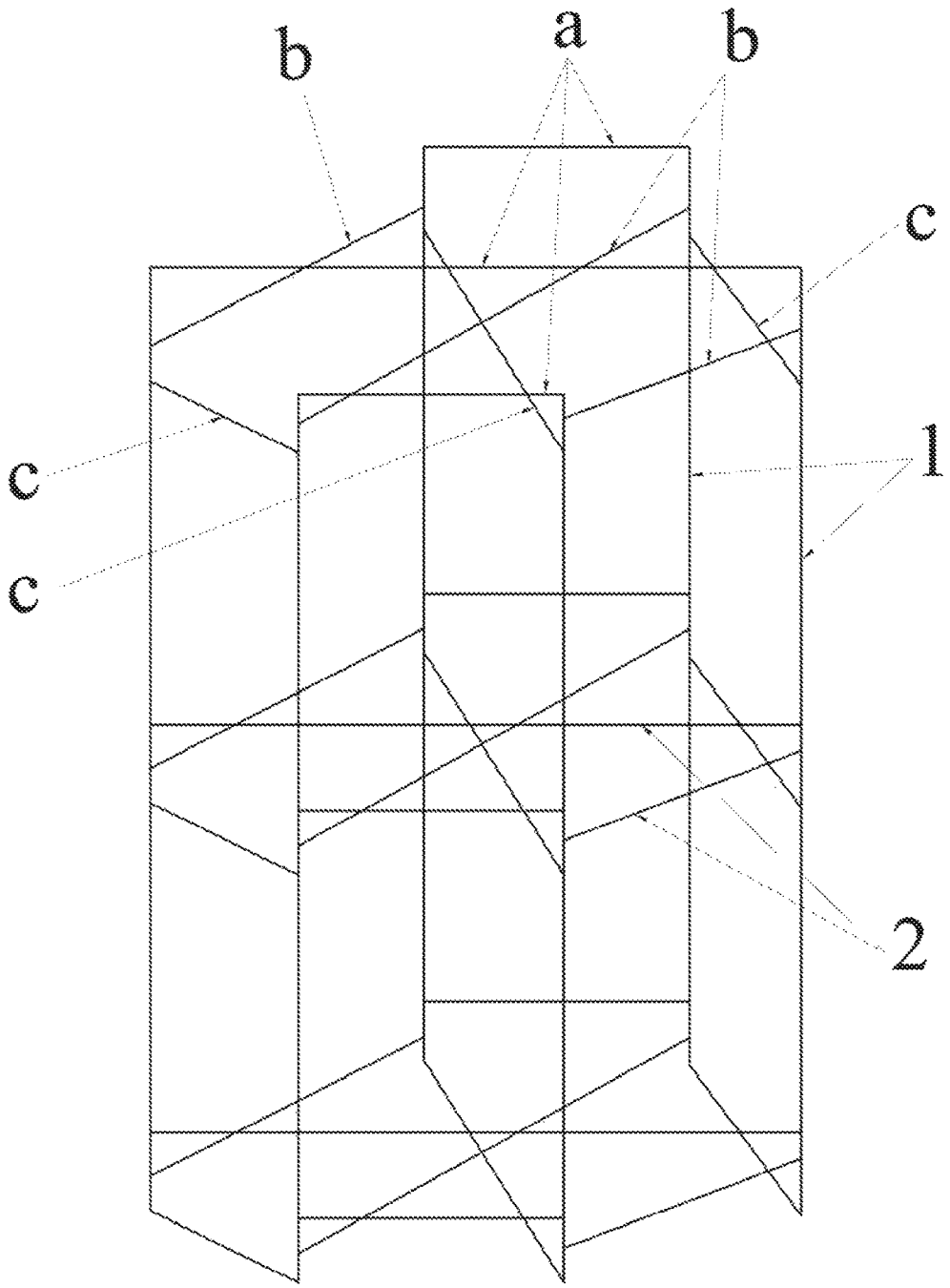
FIG. 30 is a schematic diagram of stereographic structure lines of FIG. 21, in which the position relationship between communication rods and connecting rods is reflected by lines only and the siamesed device and the connector are omitted and are not drawn.
Figure 32:
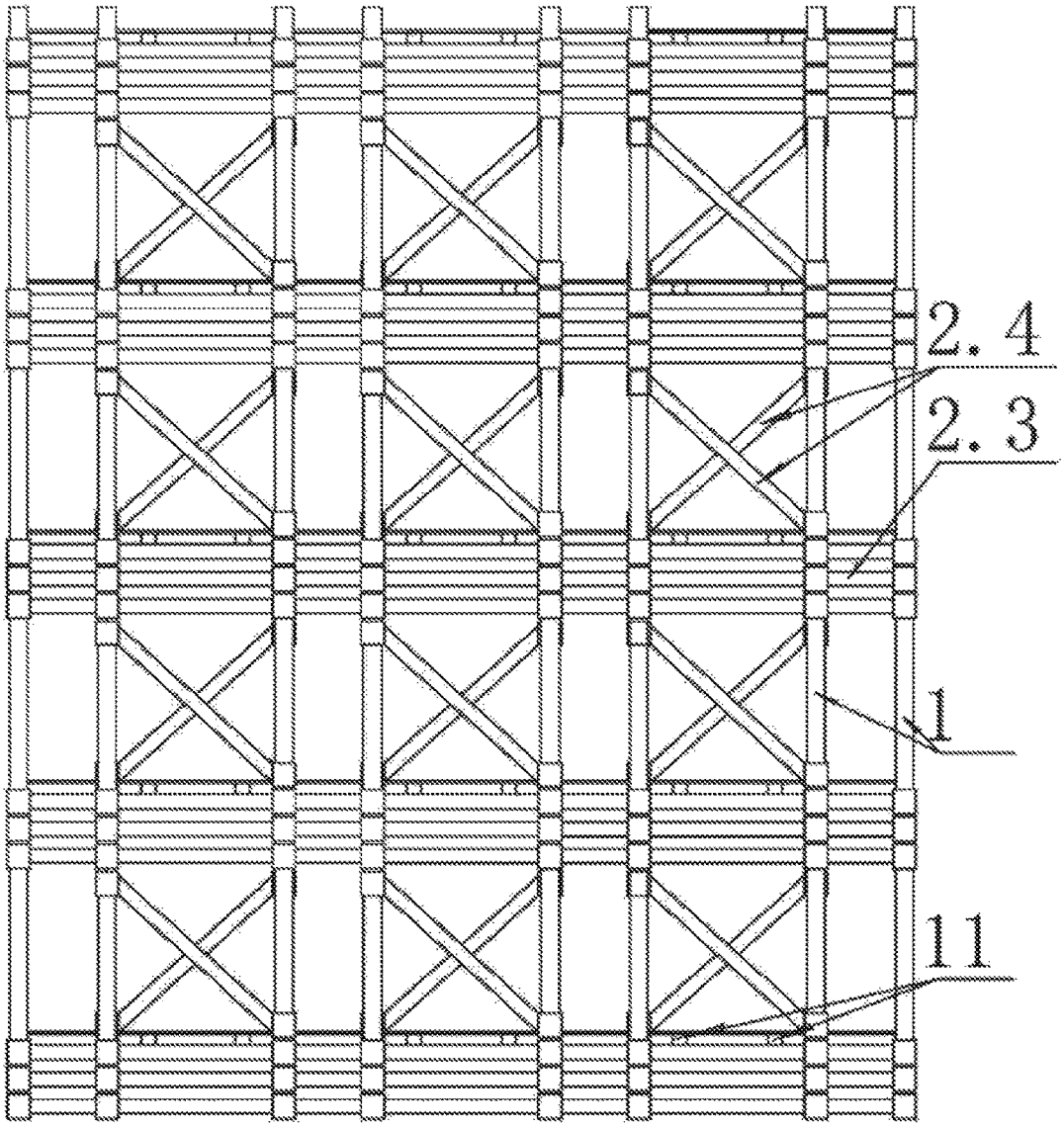
FIG. 32 is a side view of an earthquake-resistant building constructed by hexagonal stable supports of embodiment 2 of the present invention.

Embodiment 2: An Earthquake-resistant Building Constructed by Hexagonal Stable Supports of the Present Invention As shown in FIG. 32, a plurality of layers of layer surfaces formed by planar connecting rod groups which are arranged in the mode of horizontal extension are disposed at intervals in the extension directions of the communication rods which are vertically arranged, and each of the connecting rod groups comprises a plurality of planar connecting rods (2.3), wherein the plurality of planar connecting rods include edge-frame connecting rods which are arranged on six sides and a central connecting rod which is arranged in a center. The connecting rods (2.3) in each layer of planar connecting rod group are connected to form planar connection structures of which the vertical projections are in the shape of a regular hexagon by the communication rods (1), and the overall projection formed by these planar connection structures together has the same shape as the cross section of a honeycomb. The connecting rods located at six sides in the same planar connection structure (i.e. a hexagonal frame) and the central connecting rod in the center of the hexagon are connected to the communication rods (1) using a certain rule, so that the edge-frame connecting rods and the central connecting rod in the same planar connection structure are located in the horizontal planes in the adjacent positions (as shown in FIG. 30), and the connecting rods of which the extension directions are parallel to each other in the same planar connection structure are located in the same horizontal plane. The uppermost layer of planar connecting rods (2.3) which are parallel to each other on each layer of planar connecting rod group are laid with horizontal beams which form a floor surface support structure. The horizontal beams are laid with a floor plate.

Vertical support columns of an earthquake-resistant building are formed by the communication rods (1), the planar connecting rod group on each layer surface forms a planar structure beam on each floor of the earthquake-resistant building, and the planar structure beams are laid with a floor plate.

We claim:

1. A combined member, comprising:

one or more communication rods, and one or more connecting rods;

wherein the communication rod comprises a communication rod body; the connecting rod comprises a connecting rod body and a connector; wherein the connector is a sleeving connector; each of the connecting rod body and the communication rod body has a cylindrical shape; the connecting rod is connected to the communication rod through the sleeving connector; and the connecting rod and the communication rod intersect;

wherein the sleeving connector comprises an outer sleeve fixedly connected to the connecting rod body, and an inner tight sleeve sleeved outside the communication rod and fitted with the outer sleeve in a sleeving mode; wherein an inner diameter of the outer sleeve is gradually increased along a length of an inner surface of the outer sleeve; an outer surface of the inner tight sleeve is a conical surface and an outer diameter of the inner tight sleeve is gradually increased along a length of the outer surface of the inner tight sleeve; a slope of an inner surface of the outer sleeve is equal to a slope of the outer surface of the inner tight sleeve; the inner tight sleeve consists of two half cylinders; and the inner diameter of the inner tight sleeve consists of two half cylinders, and a central angle formed by the two half cylinders is slightly less than 180°; and the inner diameter of the inner tight sleeve is slightly greater than the outer diameter of the communication rod; and wherein the sleeving connector further comprises a plurality of tightening bolts; a lower part of the outer sleeve and a lower part of the inner tight sleeve are respectively provided with an upper connecting lug and a lower connecting lug; each of the upper connecting lug and the lower connecting lug is provided with a bolt hole, and the plurality of tightening bolts are fixed in the bolt hole of the upper connecting lug and the bolt hole of the lower connecting lug to connect the outer sleeve and the inner tight sleeve together.

2. A stable support formed by the combined member of claim 1, wherein the communication rods and the connecting rods are oriented to form triangular shapes; the communication rods intersect nodes of the triangular shapes; and the connecting rods are connected between the communication rods forming the stable support.

3. A combined member, comprising:

one or more communication rods, and one or more connecting rods;

wherein the communication rod comprises a communication rod body; the connecting rod comprises a connecting rod body and a connector; wherein the connector is a sleeving connector; each of the connecting rod body and the communication rod body has a cylindrical shape; the connecting rod is connected to the communication rod through the sleeving connector; and the connecting rod and the communication rod intersect;

wherein the sleeving connector comprises an outer sleeve fixedly connected to the connecting rod body, and an inner tight sleeve sleeved outside the communication rod and fitted with the outer sleeve in a sleeving mode; wherein an inner diameter of the outer sleeve is gradually increased along a length of an inner surface of the outer sleeve; an outer surface of the inner tight sleeve is a conical surface and an outer diameter of the inner tight sleeve is gradually increased along a length of the outer surface of the inner tight sleeve; a slope of an inner surface of the outer sleeve is equal to a slope of the outer surface of the inner tight sleeve; the inner tight sleeve consists of two half cylinders; and the inner diameter of the inner tight sleeve consists of two half cylinders, and a central angle formed by the two half cylinders is slightly less than 180°; and the inner diameter of the inner tight sleeve is slightly greater than the outer diameter of the communication rod; and wherein the combined member further comprises a locating ring which is arranged beneath the inner tight sleeve and fastened outside the communication rod;

wherein the locating ring comprises an annular portion and two butting portions; the two butting portions are arranged at two sides of the annular portion and extend to the two sides of the annular portion; an inner surface of the annular portion is fitted with an outer surface of the communication rod, and each of the two butting portions is provided with a bolt hole.

4. A stable support formed by the combined member of claim 3, wherein the communication rods and the connecting rods are oriented to form triangular shapes; the communication rods intersect nodes of the triangular shapes; and the connecting rods are connected between the communication rods forming the stable support.

5. A stable support formed by a combined member, wherein the combined member comprises:

one or more communication rods, and one or more connecting rods;

wherein the communication rod comprises a communication rod body; the connecting rod comprises a connecting rod body and a connector; wherein the connector is a sleeving connector; each of the connecting rod body and the communication rod body has a cylindrical shape; the connecting rod is connected to the communication rod through the sleeving connector; and the connecting rod and the communication rod intersect wherein the sleeving connector comprises an outer sleeve fixedly connected to the connecting rod body, and an inner tight sleeve sleeved outside the communication rod and fitted with the outer sleeve in a sleeving mode; wherein an inner diameter of the outer sleeve is gradually increased along a length of an inner surface of the outer sleeve; an outer surface of the inner tight sleeve is a conical surface and an outer diameter of the inner tight sleeve is gradually increased along a length of the outer surface of the inner tight sleeve; a slope of an inner surface of the outer sleeve is equal to a slope of the outer surface of the inner tight sleeve; the inner tight sleeve consists of two half cylinders; and the inner diameter of the inner tight sleeve consists of two half cylinders, and a central angle formed by the two half cylinders is slightly less than 180°; and the inner diameter of the inner tight sleeve is slightly greater than the outer diameter of the communication rod; and wherein the communication rods and the connecting rods are oriented to form triangular shapes; the communication rods intersect nodes of the triangular shapes; and the connecting rods are connected between the communication rods forming the stable support.

* * * * *